US006368453B1

(12) United States Patent
Kettunen et al.

(10) Patent No.: US 6,368,453 B1
(45) Date of Patent: Apr. 9, 2002

(54) CHIP FEEDING TO A COMMINUTED CELLULOSIC FIBROUS MATERIAL TREATMENT VESSEL

(75) Inventors: Auvo K. Kettunen, Neuvoton (FI); Richard O. Laakso, Queensbury, NY (US); C. Bertil Stromberg; J. Robert Prough, both of Glens Falls, NY (US); Jay J. Miele, Queensbury, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 09/520,761

(22) Filed: Mar. 7, 2000

Related U.S. Application Data

(60) Provisional application No. 60/124,890, filed on Mar. 18, 1999, and provisional application No. 60/138,280, filed on Jun. 9, 1999.

(51) Int. Cl.[7] ..... D21C 7/06; D21C 7/08

(52) U.S. Cl. ..... 162/52; 162/238; 162/246; 162/253

(58) Field of Search ..... 162/17, 19, 52, 162/233, 238, 246, 237, 242, 243, 248

(56) References Cited

U.S. PATENT DOCUMENTS

| | | | |
|---|---|---|---|
| 4,958,741 | A | 9/1990 | Johanson |
| 5,476,572 | A | 12/1995 | Prough |
| 5,489,363 | A | 2/1996 | Marcoccia et al. |
| 5,500,083 | A | 3/1996 | Johanson |
| 5,536,366 | A | 7/1996 | Marcoccia et al. |
| 5,547,012 | A | 8/1996 | Marcoccia et al. |
| 5,575,890 | A | 11/1996 | Prough et al. |
| 5,617,975 | A | 4/1997 | Johanson et al. |
| 5,620,562 | A | 4/1997 | Marcoccia et al. |
| 5,622,598 | A | 4/1997 | Prough |
| 5,628,873 | A | 5/1997 | Johanson et al. |
| 5,635,025 | A | 6/1997 | Bilodeau |
| 5,662,775 | A | 9/1997 | Marcoccia et al. |
| 5,700,355 | A | 12/1997 | Prough |
| 5,736,006 | A | 4/1998 | Prough |
| 5,753,075 | A | 5/1998 | Stromberg et al. |
| 5,766,418 | A | 6/1998 | Prough |
| 5,795,438 | A | 8/1998 | Stromberg et al. |
| 5,824,188 | A | 10/1998 | Prough et al. |
| 5,849,150 | A | 12/1998 | Marcoccia et al. |
| 5,849,151 | A | 12/1998 | Marcoccia et al. |

*Primary Examiner*—Dean T. Nguyen
(74) *Attorney, Agent, or Firm*—Nixon & Vanderhye P.C.

(57) ABSTRACT

In the feeding of a slurry of comminuted cellulosic fibrous material to a digester (continuous or batch) in the production of chemical pulp, one of the tanks used in the feed system (which preferably includes a high pressure feeder) may be eliminated without consequent loss of its function by providing a single tank with the combined functions of controlling the level of liquid in a slurrying conduit which supplies slurry to a slurry pump, and storing and substantially continuously supplying liquid to a make-up liquid pump connected to the digester. The single tank preferably surrounds the slurrying conduit and is substantially concentric, and in liquid communication, with it. A gap of 3–48 inches may be provided between the bottom of the conduit and a connection to the slurry pump. A screen or strainer may be provided in the gap, which is substantially surrounded by the tank. The return system from the low pressure outlet of the high pressure feeder to the slurrying device (like the conduit and tank surrounding it, or a conventional clip tube) may be devoid of one or more of an in-line drainer, level tank, centrifugal separator, and surge tank.

12 Claims, 12 Drawing Sheets

CHIP FEEDING TO A COMMINUTED CELLULOSIC FIBROUS MATERIAL TREATMENT VESSEL

CROSS-REFERENCE TO RELATED APPLICATION

This application is based upon provisional applications Ser. No. 60/124,890 filed Mar. 18, 1999, and Ser. No. 60/138,280 filed Jun. 9, 1999, the disclosures of which are hereby incorporated by reference herein.

BACKGROUND AND SUMMARY OF THE INVENTION

U.S. Pat. Nos. 5,476,572; 5,622,598; 5,635,025; 5,736,006; 5,753,075; 5,766,418; and 5,795,438 disclose methods and devices for feeding a slurry of comminuted cellulosic fibrous material to a treatment vessel that have revolutionized the art of treating comminuted cellulosic fibrous material to produce cellulose pulp. The disclosed inventions, sold under the trademark LO-LEVEL by Ahistrom Machinery Inc., of Glens Falls, N.Y., employ one or more slurry-type pumps for treating and transferring comminuted cellulosic material to one or more treatment vessels. Not since the initial development of the continuous cooking process in the 1940s and 1950s have such dramatic improvements been made to the equipment used to transfer material to a treatment vessel, for example, a continuous or batch digester. This is confirmed by the broad acceptance of this technology by the Pulping Industry.

The present invention introduces improvements to the systems described in the above patents which further simplify and enhance the effectiveness of the methods and devices disclosed in the above referenced patents. U.S. Pat. No. 5,622,598 discloses a process of using a slurry-type pump to transfer a slurry of comminuted cellulosic fibrous material to a digester, for example, by pumping the slurry to a high-pressure transfer device and then-transporting the slurry via the transfer device to one or more digesters. In particular, the method and apparatus disclosed in U.S. Pat. No. 5,622,598 provide a separate supply of liquid to the slurry pump inlet to, among other things, facilitate the transfer of comminuted cellulosic fibrous material to the pump.

Typically, this liquid is supplied by a separate storage vessel having a conduit which can discharge liquid to the inlet of the pump. A level of liquid is maintained and regulated within this vessel.

The present invention further simplifies the equipment necessary to effect the feeding of comminuted cellulosic fibrous material to a digester by, among other things, substantially eliminating the need for a separate liquor storage vessel and substantially eliminating the need for a separate level controlling vessel or tank. The liquid supplying function of this vessel or tank and the maintenance of the level of liquid within this tank are replaced by a liquor storage vessel located integrally with the conduit that passes the slurry of material from the pretreatment vessel, for example, a chip bin, to the inlet of the slurry pump.

One aspect of this invention comprises or consists of a comminuted cellulosic fibrous material treatment system, comprising (or consisting of): a digester having a comminuted cellulose material inlet at the top thereof; a first vessel, at a first pressure, containing comminuted cellulosic fibrous material, and having a top, a bottom, and an outlet adjacent the bottom; a conduit having an inlet communicating with the outlet of the first vessel, and an outlet; a second vessel, having a width dimension greater than the conduit, for receiving the cellulosic material from the conduit and having a level of liquid therein; and a slurry pump having an inlet for receiving material from the second vessel and an outlet operatively connected to the inlet of the digester. The digester may be one or more continuous or batch digesters.

The system preferably includes some form of metering device, such as a star-type or screw-type metering device, located between the outlet of the first vessel and the inlet of the conduit. A pressure isolation device, for example, a star-type pressure-isolation device, may also be located between the outlet of the first vessel and the inlet of the conduit, with or without the presence of a metering device.

The second vessel preferably substantially surrounds a peripheral portion of the conduit, and the second vessel has a top through which the conduit passes and a bottom having an outlet communicating with the inlet of the slurry pump. In a preferred embodiment, the second vessel is concentric with the first vessel and the conduit, and the outlet of the conduit is located below the top of the second vessel, but above the outlet of the second vessel.

The present invention also preferably includes a high pressure rotary transfer device having a low pressure inlet, a low pressure outlet, a high pressure inlet, and a high pressure-outlet. The high pressure inlet is operatively connected to the outlet of the second vessel and the high pressure outlet is operatively connected to the digester for feeding the comminuted cellulosic fibrous material slurry to the digester.

The second vessel of the present invention also preferably includes a conduit for introducing cooking liquor into the second vessel.

The first vessel is preferably a chip bin for storing and treating the cellulose chips, preferably a chip bin having one-dimensional convergence and side-relief geometry, for example, a DIAMONDBACK Chip Bin as described in U.S. Pat. Nos. 4,958,741; 5,500,083; 5,617,975; 5,628,873; and 5,700,355 and sold by Ahlstrom Machinery Inc. The first vessel may also be a horizontal Steaming Vessel having a screw conveyor, as sold by Ahlstrom Machinery. The first vessel may also have "chisel"-type geometry as disclosed in co-pending application Ser. No. 09/055,408 filed Apr. 6, 1998 now U.S. Pat. No. 6,199,299. The pressure in the first vessel is typically between about 0 and 5 bar gauge, preferably between about 0 and 2 bar gauge. The second vessel may also have one-dimensional convergence and side-relief geometry or chisel-type geometry to minimize the potential for bridging or plugging.

The present invention also includes a method of feeding a slurry of comminuted cellulosic fibrous material in liquid to a digester having an inlet utilizing a pre-treatment vessel, and a slurry pump having an inlet. The method comprises (a) pretreating the comminuted cellulosic fibrous material in the pretreatment vessel; (b) passing the pretreated material from the pretreatment vessel into a first conduit; (c) discharging the material from the first conduit into a vessel having a width dimension greater than the first conduit; (d) entraining the comminuted cellulosic fibrous material in liquid to form a slurry; (e) feeding the slurry to the inlet of the slurry pump; and (f) transporting the slurry to the inlet of the digester.

The invention preferably also includes a high-pressure transfer device having a low-pressure inlet and a high pressure outlet and the method further includes, between (e) and (f), (g) pumping the slurry with the slurry pump to the low-pressure inlet of the high-pressure feeder, and (h) discharging the slurry from the high-pressure outlet of the high-pressure feeder. The method may also include, between steps (c) and (d), (i) metering the flow of comminuted cellulosic fibrous material from the pretreatment vessel. The method may also further comprise passing the liquid from the low pressure outlet through an in-line drainer; pressurizing the liquid from the in-line drainer in a pressurizing device, and passing liquid from the pressurizing device to the digester; passing some liquid directly from the tank to just prior to the pressurizing device; and/or passing some of the pressurized liquid from the pressurizing device to the high pressure inlet to or outlet from the high pressure feeder.

The present invention also includes a system for feeding-comminuted cellulosic material entrained in liquid to a high pressure feeder connected to a digester, comprising: a vertical treatment vessel having a discharge at the bottom thereof; a metering device connected to the discharge of the treatment vessel; a generally vertical chute extending downwardly from the metering device; a high pressure feeder connected to a digester; a slurry pump which pumps a slurry of comminuted cellulosic material in liquid, the slurry pump having an inlet, the pump connected to the high pressure feeder; and a vessel having a width dimension greater than the width dimension of the chute, positioned concentric with the chute, and having a liquor level therein and an outlet operatively connected to the slurry pump inlet.

According to another aspect of the present invention there is provided a system for feeding comminuted cellulosic fibrous material in a liquid slurry to at least one digester, comprising: A device which slurries comminuted cellulosic fibrous material in liquid. A first pump for pumping slurry from the slurrying device to at least one digester. A second pump for supplying make-up liquid to the digester. A source of liquid for slurrying the comminuted cellulosic fibrous material. And, a single tank which performs both the function of controlling the level of liquid in the slurrying device, and the function of storing and supplying liquid in association with the source to the second pump, so that the first pump is properly and effectively substantially continuously supplied with liquid slurry, and the second pump with liquid.

Preferably the slurrying device includes a substantially vertical conduit, and the single tank substantially surrounds the conduit and is in liquid communication therewith. Typically the first pump is operatively connected to the substantially vertical conduit by a connecting conduit or transition; and there is a gap between the substantially vertical conduit and the connecting conduit or transition; and the single tank substantially surrounds the gap. Normally the gap has a substantially vertical dimension of between about 3–36 inches, and a screen or strainer is provided at the gap to minimize the amount of comminuted cellulosic fibrous material passing into the single tank through the gap. Optionally, the substantially vertical conduit is in further liquid communication with the single tank by at least one opening in the conduit vertically above and spaced from the gap.

The single tank may be substantially concentric (preferred), or offset, with respect to the substantially vertical conduit. In one embodiment a single tank comprises or consists essentially of a substantially right cylindrical upper portion and a substantially right circular one frustum lower portion. In another embodiment the single tank has a substantially right cylinder shape. In another embodiment the single tank is spaced and distinct from the slurrying device.

The system also preferably comprises a high pressure feeder connected to the first pump and having a low pressure outlet; an undesirable solids separator connected to the low pressure outlet; an in-line drainer connected to the separator; the in-line drainer having a first outlet line connected to the second pump, and a second outlet line connected to the slurrying device; and an automatically controlled flow-controlling valve in the second outlet line which controls the proportion of liquid from the in-line drainer flowing in the first outlet line compared to the second outlet line. Preferably the second outlet line, downstream of the valve, is substantially directly connected to both the substantially vertical conduit above the single tank and to the single tank.

The invention also comprises a method of feeding comminuted cellulosic fibrous material to a digester using a high pressure transfer device having a high pressure inlet and outlet, and low pressure inlet and outlet; comprising: a) Slurrying the material with liquid prior to feeding the slurry into the low pressure inlet. b) Returning liquid and any entrained material from the low pressure outlet to the low pressure inlet in a return system devoid of an in-line drainer and level tank. c) Pressurizing the slurry in the high pressure transfer device by pumping high pressure liquid into the high pressure inlet of the transfer device. And, d) passing the liquid from the high pressure outlet of the transfer device to the digester.

In the above described method b) may be further practiced using a return system also devoid of a centrifugal separator (sand separator); and/or also devoid of a surge tank. The method may further comprise removing tramp material from liquid circulating to or from the high pressure transfer device using a tramp metal trap. Further a) through d) may be practiced without a screen in the low pressure outlet.

According to another aspect of the present invention there is provided a feed system for a digester, comprising: A high pressure transfer device having a high pressure inlet and outlet, and low pressure inlet and outlet. A slurrying device connected to the low pressure inlet which slurries comminuted cellulosic fibrous material with liquid. A high pressure pump for pressurizing liquid being fed to the high pressure inlet. A connection between the high pressure outlet and a digester. A return system for returning liquid from the low pressure outlet to the slurrying device. And, the return system devoid of an in-line drainer and level tank.

The system as described above may further comprise a pump (e.g. a screw pump) not adversely affected by the presence of comminuted fibrous material in fluid pumped thereby, the pump connected between the return system and a digester. The low pressure outlet may be devoid of a screen. The return system may also be devoid of a centrifugal separator and/or surge tank. The system may further comprise a tramp material trap which removes tramp material from liquid circulating to or from the high pressure feeder.

Typically there is a pump between the slurrying device and the low pressure inlet, and the slurrying device may be a substantially vertical conduit substantially surrounded by a single tank which performs both the function of controlling the level of liquid and storing and substantially continuously supplying liquid to the pump (as described more fully above).

It is the primary object of the present invention to provide a simplified system and method for effectively feeding a comminuted cellulosic fibrous material slurry to continuous or batch digesters in the production of chemical cellulose pulp. This and other objects of the invention will become clear from the following detailed description of the invention, and the appended claims.

DETAILED DESCRIPTION OF THE DRAWINGS

Figure 1:
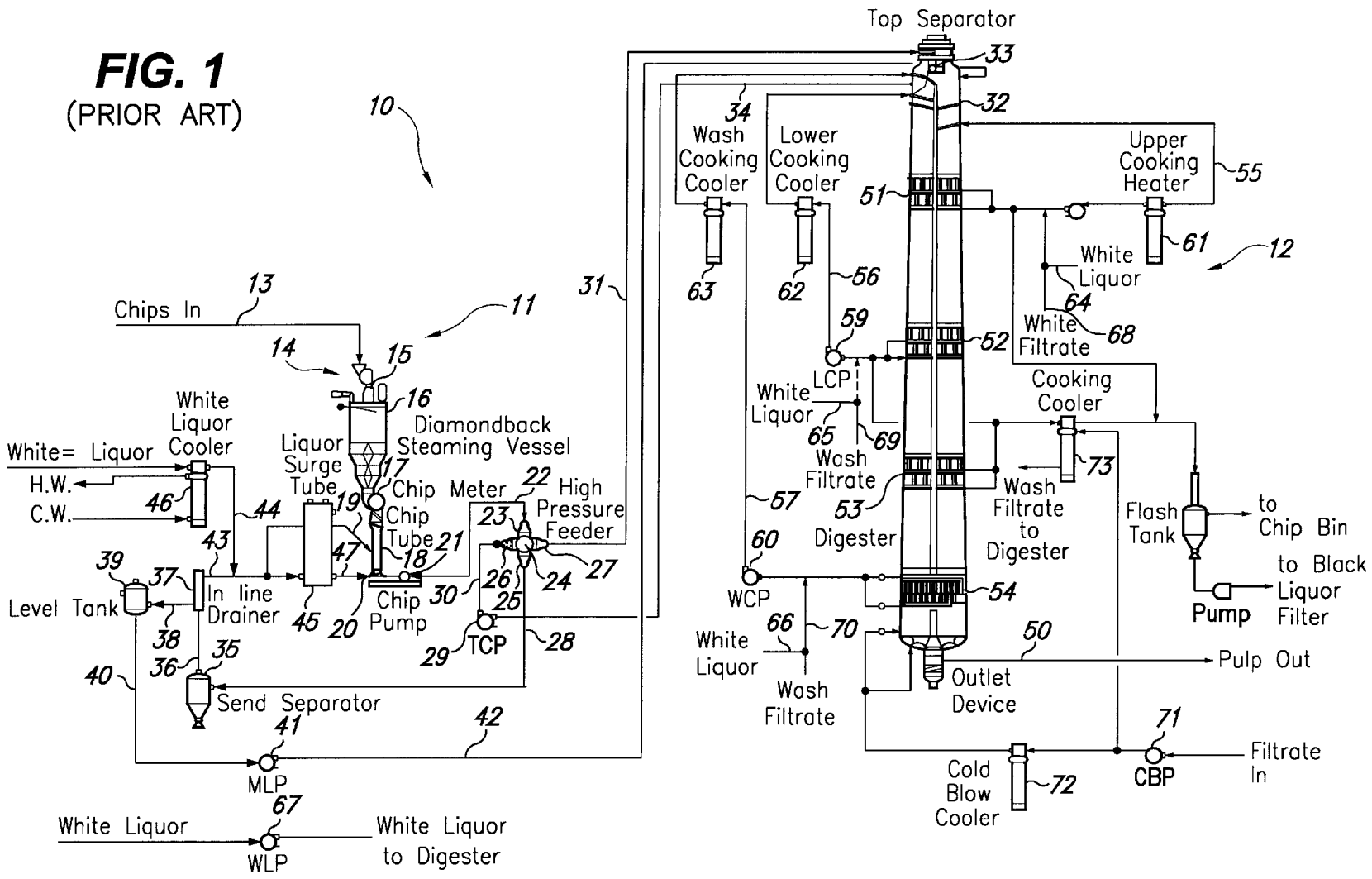
FIG. 1 (PRIOR ART)
FIG. 1 is a schematic view of a continuous digester system employing a prior art feed system over which the present invention is an improvement.
Figure 2:
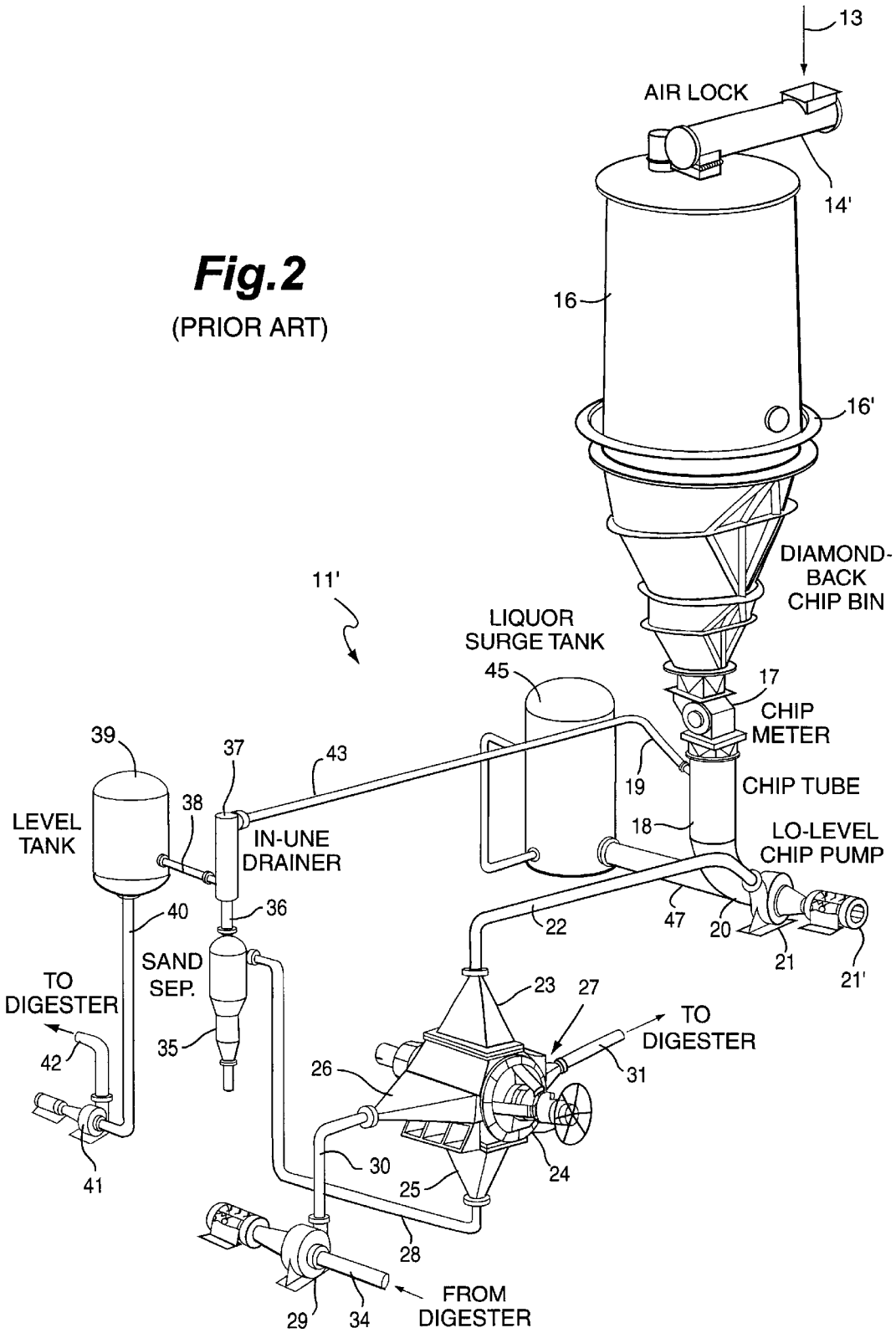
Fig.2 (PRIOR ART)
FIG. 2 is detailed perspective schematic view of the prior art feed system used in the digester system of FIG. 1.

FIGS. 1 and 2 illustrate typical prior art systems for handling the feeding and treatment of comminuted cellulosic fibrous material to produce cellulose pulp. FIG. 1 schematically illustrates a feed system 11, and FIG. 2 is a detailed view of a similar feed system 11' for introducing, steaming, slurrying and pressurizing comminuted cellulosic fibrous material, for example, hardwood or softwood chips, and feeding the slurry to a continuous digester system 12. Though comminuted cellulosic fibrous material may take many forms, including sawdust; grasses, such as straw or kenaf; agricultural waste, such as bagasse; recycled paper; for the sake of simplicity, the term "chips" will be used when referring to comminuted cellulosic fibrous material, but any and all of the listed materials, and others not listed, may be processed by the present invention. Also, though a continuous digester in shown in FIG. 1, it is understood that the present invention is also applicable to discontinuous or batch digesters.

As shown in FIGS. 1 and 2, chips 13 are introduced to the system, for example, by a conveyor (not shown) from a chip storage facility, for example, a woodyard, by an isolation and metering device 14, 14' for example FIG. 1 illustrates a star-type Air-lock Feeder 14 as sold by Ahistrom Machinery Inc. of Glens Falls, N.Y. FIG. 2 illustrates a screw-type isolation device 14' as described in U.S. Pat. No. 5,766,418 and having a similar function to the device 14 of FIG. 1. The devices 14, 14', driven by an electric motor (not shown), introduce the chips to a chip retention and streaming vessel 16 via a counter-weighted gate assembly 15. Though various types of vessels known in the art may be utilized, vessel 16 is preferably a Diamondback® Steaming vessel as marketed by Ahistrom Machinery and described in U.S. Pat. Nos. 5,500,083; 5,617,975; 5,628,873; and 4,958,741, or a CHISELBACK vessel as described in co-pending application Ser No. 09/055,408 filed Apr. 6, 1998 now U.S. Pat. No. 6,199,299. The vessel 16 typically includes a gamma-radiation level-detection system, a regulated vent for discharging gases which accumulate in the vessel and one or more steam introduction conduits (16' in FIG. 2), as is conventional. The pressure in the vessel 16 may be slightly below atmospheric pressure or slightly above atmospheric pressure, that is, the pressure in vessel 16 may vary from about 1 to 2 bar gage (that is, about 0 to 3 bar absolute).

During treatment with steam in vessel 16, the air that is typically present in the chips displaced by steam and heating of the chips is initiated. The removal of air from the cavities within the chips permits more efficient diffusion of cooking chemical into the chips and minimizes the buoyant forces on the chips during subsequent processing.

The steamed material is discharged from the bottom of the vessel 16 to a metering device 17, for example, a star-type metering device or Chip Meter as sold by Ahistrom Machinery, though any type of conventional metering device may be used. The metering device 17 is typically driven by an electric motor (not shown) and the speed of rotation of the metering device is typically controlled by operator input to define a set rate of introducing chips to the system. The chips discharged by the metering device 17 are introduced to a vertical conduit or pipe 18, for example, a Chip Tube sold by Ahistrom Machinery. Cooking chemical and other liquids are typically first introduced to the chips in conduit 18 via one or more conduits 19 so that a level of liquid is established in conduit 18 and a slurry of chips and liquid is present in the bottom of conduit 18. This level of liquid is typically monitored and controlled by a level detection device, for example, a gamma-radiation level detection device, or a "d-p" cell. The metering device 17 typically does not act as a pressure isolation device, though it may, and the pressure in conduit 18 typically varies from about 0 to 2 bar gage (or about 1 to 3 bar absolute).

Conduit 18 discharges the slurry of chips and liquid by a radiused section 20 to the inlet of slurry pump 21. Though any slurry pump can be used, pump 21 is preferably a Hidrostal screw centrifugal pump sold by Wemco Pump of Salt Lake City, Utah or a pump supplied by Lawrence Pumps of Lawrence, Mass. Slurry pump 21, driven by electric motor 21' (see FIG. 2), pressurizes and transfers the slurry in conduit 18 via conduit 22 to the low pressure inlet 23 of a high pressure transfer device 24. The high pressure transfer device 24 is preferably a High-pressure Feeder as sold by Ahlstrom Machinery. High-pressure feeder 24 includes a pocketed rotor mounted in a housing typically having a low-pressure inlet 23, a low-pressure outlet 25, a high-pressure inlet 26, and a high-pressure outlet 27. The low-pressure outlet 25 typically includes a screen plate (not shown) which minimizes the passage of chips out of low-pressure outlet 25 while allowing the liquid in the slurry to pass through outlet 25 to the conduit 28. The chips which are retained in the feeder by the screen are slurried with high-pressure liquid provided by pump 29, preferably a Top Circulation Pump (TCP) provided by Ahistrom Machinery, to inlet 26 via conduit 30, and discharged out of high-pressure outlet 27 into conduit 31 and to the digester 32 of digester system 12 at a pressure of between about 5 and 15 bar gage, typically between about 7 to 12 bar gage.

Digester 32 (see FIG. 1) may be a single or multiple-vessel digester and may be hydraulic or steam-phase digester, or another type of conventional digester. Digester 32 ay also consist or comprise one or more batch digesters. The cellulose material with added cooking chemical is treated under temperature and pressure in digester 32 and essentially fully-treated cellulose pulp is discharged into conduit 50 at the bottom of the digester 32. Digester 32 typically includes a plurality of screen assemblies 51, 52, 53, and 54; liquor circulations 55, 56, and 57 having pumps 58, 59, and 60 and heat exchangers 61, 62, and 63; and cooking liquor introduction conduits 64, 65, and 66, supplied by pump 67, as is conventional, in order to treat the cellulose material. Though many types of processes may be performed in digester 32, one preferred process is the process described in U.S. Pat. Nos. 5,489,363; 5,536,366; 5,547,012; 5,575,890; 5,620,562; 5,662,775; 5,824,188; 5,849,150; and 5,849,151 and marketed by Ahlstrom Machinery under the trademark LO-SOLIDS. According to this preferred process, one or more dilution liquid (for example, wash filtrate) introduction conduits 68, 69, and 70 are provided which are supplied by filtrate pump 71, also known as a Cold Blow Pump (CBP). The liquid pressurized by pump 71 may be heated or cooled as desired by heat exchangers 72 and 73. The processes described in U.S. Pat. Nos. 5,635,026 and 5,779,856 and marketed by Ahistrom Machinery under the trademark EAPC™ may also be performed in digester 32.

As shown in FIG. 1, excess liquor in the slurry in conduit 31 at the top of the digester 32 is separated from the slurry by a liquor separator 33 and returned to the feed system 11 via a conduit 34 (also shown in FIG. 2). The liquid in conduit 34 is pressurized by pump 29, driven by electric motor 29' (FIG. 2), and provides the pressurized slurrying liquid introduced to the high-pressure inlet 26 of feeder 24 via conduit 30. Feeder 24 is typically driven by an electric motor (not shown), the speed of which is monitored and controlled.

As shown in both FIGS. 1 and 2, the liquid discharged from the low-pressure outlet 25 of the high-pressure feeding device 24 passes via conduit 28 to a cyclone-type separator 35 which removes undesirable material and debris, such as sand, stones, etc., from the liquid in conduit 28. The separator 35 is preferably a Sand Separator as sold by Ahlstrom Machinery. Liquid having little or no undesirable material or debris is discharged from separator 35 and is passed through a liquor separating device 37 via conduit 36. At least some liquid is removed from the liquid separator 37, which is preferably an Inline Drainer as sold by Ahistrom Machinery, via conduit 38 and sent to vessel 39. Vessel 39 is preferably a Level Tank as sold by AhIstrom Machinery. Liquid is discharged from vessel 39 to conduit 40 and pump 41 and is supplied to digester 32 (see FIG. 1) as liquor make-up as needed via conduit 42. Pump 41 is preferably a Make-Up Liquor Pump (MLP) as sold by Ahlstrom Machinery.

The liquid discharged from separator 37 into conduit 43 may be supplemented with cooking chemical, for example, kraft white, green, orange (that is, liquid containing polysulfide additives), or black liquor, introduced via conduit 44 (see FIG. 1) prior to being introduced to tank 45. Tank 45 is preferably a Liquor Surge Tank as sold by Ahistrom Machinery and described in U.S. Pat. No. 5,622,598. The cooking chemical introduced via conduit.44 may be heated or, preferably, cooled as needed by indirect heat exchanger 46 (see FIG. 1). Some of the liquid in conduit 43 may bypass tank 45 and be introduced via conduit 19 to conduit 18 as described above. Tank 45 communicates with conduit 18 and the inlet of pump 21 via conduits 47 and 20.

According to the prior art, as described most clearly in U.S. Pat. No. 5,622,598, tank 45 is preferably provided to supply sufficient liquid to the inlet of pump 21 via conduit 47 to ensure that the pump inlet is always provided with liquid, that is, it substantially eliminates the possibility of running the pump 21 "dry". At the same time, this large volume of liquid which communicates with the liquid in conduit 18, that is, the Chip Tube, minimizes the potential for large variations in the level of liquid within conduit 18. As will be shown below, the present invention further improves and also simplifies the apparatus needed to provide this function.

Figure 3:
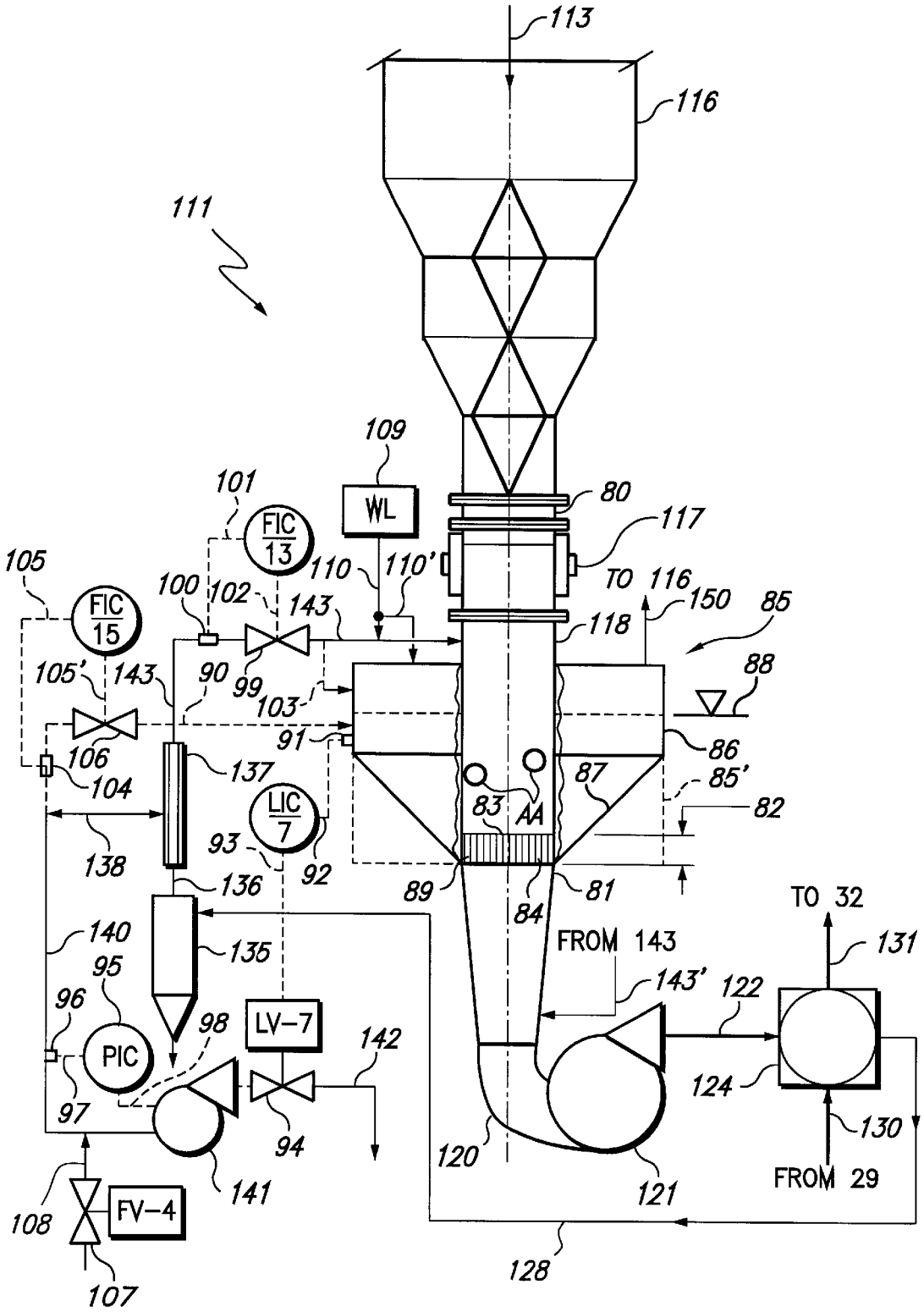
FIG. 3 is a schematic illustration of one embodiment of the system of the present invention.
Figure 4:
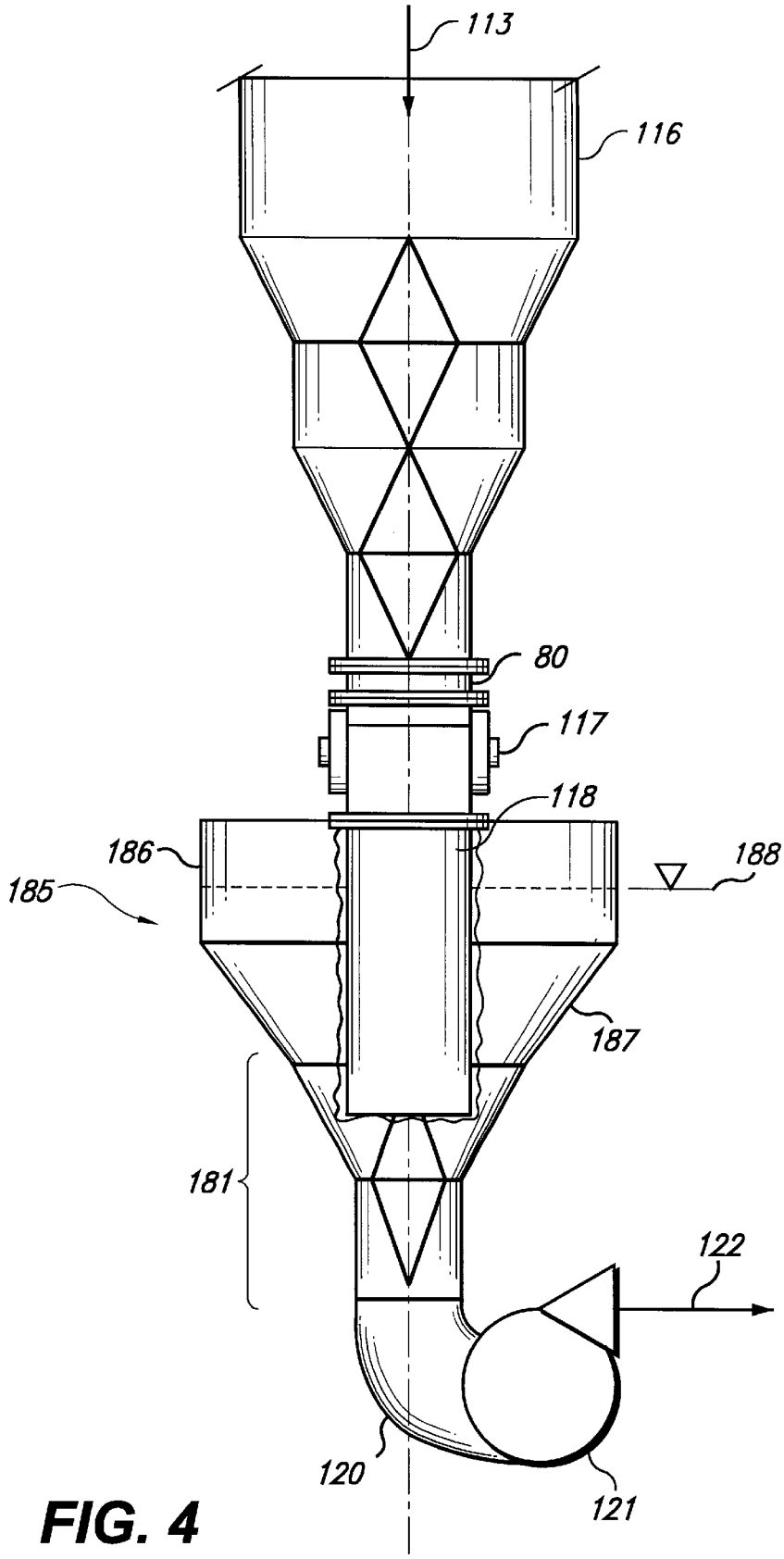
FIG. 4 is a schematic side view of a main component of another embodiment of the system of the present invention.
Figure 5:
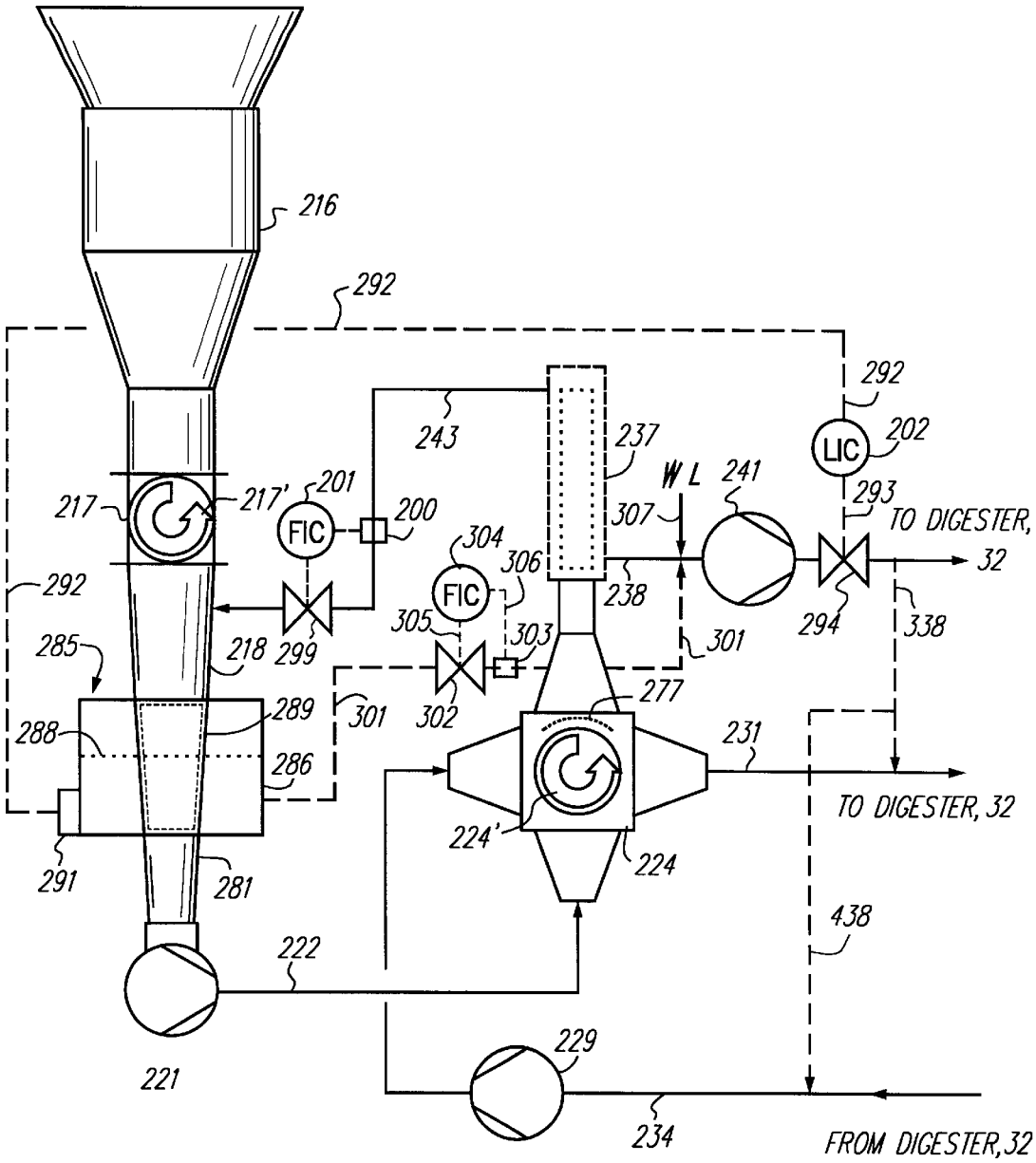
FIG. 5 is a view like that of FIG. 3 of another embodiment according to the invention.

FIGS. 3–5 illustrate three embodiments of the present invention. The typical embodiments illustrated in FIGS. 3 and 5 are improvements over the prior art system shown in FIGS. 1 and 2 and comprise or consist of many of the structures shown in FIGS. 1 and 2. Structures or devices that appear in FIG. 3 which are essentially identical to the structures or devices shown in FIGS. 1 and 2 are labeled with similar identifying numbers but these numbers are prefaced by the numeral "1". Structures or devices that appear in FIG. 5 that are similar to those in FIGS. 1–3 are shown by the same two digit reference number only preceded by a "2".

In the embodiment shown in FIG. 3, comminuted cellulosic fibrous material 113, for example, wood chips, is introduced to a treatment vessel 116 of feed system 111. Vessel 116 is preferably a DIAMONDBACK Steaming Vessel as described above. In FIG. 3 and 4, for ease of illustration, only the bottom of vessel 116 is illustrated. The cross-hatching at the top of the vessel is meant to indicate that the vessel is actually larger in size and is similar if not identical in size and geometry to vessel 16 shown in FIGS. 1 and 2.

After treatment in vessel 116 the chips are passed to a metering device 117 via a transition conduit 80 as is conventional. Again, as before, metering device 117 may be any type of star-type or screw-type metering device but is preferably a Chip Meter provided by AhIstrom Machinery. The chips are then metered by metering device 117 to a substantially vertical conduit 118, similar to conduit 18 of FIGS. 1 and 2, but conduit 118 does not extend down to radiused conduit 120 and the inlet of pump 121 as conduit 18 extends down to radiused conduit 20 and the inlet of pump 21 in FIGS. 1 and 2. Instead, in a fashion which distinguishes the present invention from the prior art, conduit 118 terminates at an elevation above the top of a conduit 81 so that a gap 82 is present between the outlet 83 of conduit 118 and the inlet 84 of conduit 81. Conduit 118 may be circular or non-circular in cross section, for example, rectangular, in cross section.

According to the present invention conduit 118 passes into a larger vessel 85 having a width or diameter dimension larger than the width or diameter of conduit 118. This vessel (tank) 85 may by a right cylindrical vessel having a rectangular profile as shown in phantom by outline 85' in FIG. 3, or preferably, as shown in solid line in FIG. 3, vessel 85 may consist of or comprise a right cylindrical part 86 followed by a downwardly-converging, right-conical-shaped or frustum-shaped part 87. Conduit 118 may be concentric with vessel 85 or may be offset from the centerline of vessel 85, but preferably vessel 85 substantially surrounds the periphery of conduit 118; vessel 85 is shown cut away in FIG. 3 to expose the conduit 118. Vessel 85 may be rotationally symmetric about its centerline or may be non-symmetric about its centerline.

According to the invention, the lower part of vessel 85, be it right-cylindrical or right-conical, is connected to the upper inlet 84 of conduit 81. A level of liquid 88 is maintained in vessel 85, and a similar liquid level is maintained in conduit 118; that is, the inside of conduit 118 may typically communicate with the inside of conduit 85 though openings, e.g., openings AA in FIG. 3, in conduit 118 so that the pressure and liquid level 88 within the conduit 118 and the vessel 85 are essentially the same. The level of liquid 88 within conduit 118 and vessel 85 may also be different, e.g., by providing no additional (except at gap 82) or restricted communication therebetween. The slurry of chips and liquid created when the chips in conduit 118 are immersed in the liquid in vessel 85 flow through conduit 81 to the radiused conduit 120 and to the inlet of pump 121. Conduit 81 is shown in FIG. 3 as a converging conduit, but this conduit may preferably be a straight non-converging or, possibly, a diverging conduit. Though FIG. 3 illustrates a radiused conduit 120 feeding the inlet of pump 121, it is understood by those skilled in the art that the pump 121, for example, a Wemco Hidrostal pump, may be mounted so that the inlet of the pump is directed upward so that the inlet can be mated directly to vertical conduit 81 and no radiused conduit 120 is necessary.

The liquid defined by the liquid level 88 provides the liquid that ensures that sufficient liquid is available at the inlet of the pump.121 and minimizes the potential of letting the inlet to the pump 121 run dry. That is, the vessel 85 and the liquid it contains provides the function of liquor surge tank 45 in FIGS. 1 and 2 so that such a tank 45 is no longer needed.

The pump 121 feeds the chip slurry to the top of the continuous or batch digester 32 via high-pressure transfer device 24, 124 and conduit 31, 131 as shown in FIGS. 1 and 2. The slurry may also be pumped directly to a batch or continuous digester by one or more pumps 121 as disclosed in U.S. Pat. No. 5,753,075. The slurry may also be pumped to a plurality of batch or continuous digesters as disclosed in U.S. Pat. No. 5,795,438.

The internal width dimension, either diameter or width, of conduit 118 is typically between about 3 and 48 inches, preferably between about 12 and 36 inches, for example, between about 20 and 30 inches in diameter. The internal width dimension, either diameter or width, of vessel 85 is typically between about 2 and 12 feet, preferably between about 3 and 9 feet, for example, about 6 feet in diameter. The gap 82 between the outlet 83 of conduit 118 and inlet 84 of conduit 81 may vary from about 3 inches to 3 feet, but is preferably between about 1 to 2 feet, for example, about 18 inches.

In a preferred embodiment of the invention the gap 82 between the outlet 83 of conduit 118 and the inlet 84 of conduit 81 is replaced by a perforated cylinder or screen 89 (see FIG. 3). The perforated cylinder 89 directs the slurry from the outlet 83 of conduit 118 directly to the inlet 84 of conduit 81 and minimizes the entry of chips into vessel 85. The perforated cylinder 89 may be made from perforated plate or may be a parallel-bar type construction.

Many of the other structures and devices used in the prior art may also be used for the present invention. For instance, pressurized liquid may be introduced to the high-pressure inlet of feeder 124 via conduit 130, for example, by a pump 29 (see FIG. 2) to propel the slurry from feeder 124 to the digester 32. Liquid discharged from the low-pressure outlet of feeder 124 is passed via conduit 128 to a conventional separator 135, again, preferably a Sand Separator, and then via conduit 136 to separator 137, again, preferably an In-line Drainer, having first and second outlet lines 138, 143, respectively. Though the illustrated (in FIG. 3) flow through separator 137 is vertically upward, it is to be understood that the flow through 190 separator 137 may also be vertically downward and still effect the desired liquor separation. The liquid which passes though separators 135 and 137 is typically passed by conduit 143 to conduit 118 or vessel 85 to provide the level of liquid 88 in vessel 85. Also, some liquid in conduit 143 may also be directed to the bottom of conduit 81 or to conduit 120 via conduit 143', for example, to prevent the introduction of excess heat by the liquid in conduits 90 and 143 to the space above the liquid level 88 in vessel 85; however, this mode of operation may only be preferred during start-up conditions-introducing excess liquid directly to the inlet of pump 121 may not be preferred during normal operation.

The liquid removed by separator 137 may be passed via conduit 138 to conduit 140 and to pump 141 to supply make-up liquor to the digester 32 via conduit 142 as is conventional. However, due to the level controlling function now performed in vessel 85, the tank 39 shown in FIGS. 1 and 2, that is, the Level Tank, is no longer necessary according to the present invention. If necessary, some of the liquid removed from separator 137 can be passed to the vessel 85 (or to conduit 118) via conduit 90. If necessary, the liquids in conduits 90 and 143 may be passed through a heat exchanger (not shown) to heat or cool the liquid in these conduits prior to introducing them to conduit 118 or vessel 85. This may be desired when the liquor in these conduits is at a temperature above the flash temperature of the pressure in conduit 118 and vessel 85 so that flashing in conduit 118 and vessel 85 will be minimized.

Cooking liquor 109, for example, kraft white, green, orange, or black liquor, or liquor containing strength or yield enhancing additives such as anthraquinone, polysulfide, sulfur, surfactants, or their equivalents or derivatives, may be added to the feed system 111 either via conduit 110, to conduit 143, or directly to vessel 85 via conduit 110'. Vessel 85 also preferably includes a vent 150 for venting gases which accumulate in the space above level 88, for example, steam, sulfur-bearing gases, or non-condensable gases (NCGs). These gases can be forwarded to the mills NCG collection system or, preferably, these gases are used as part of the gases introduced to conduit 116 to treat the incoming chips.

Some of the more significant control features of the present-invention are also illustrated in FIG. 3. First, the level of liquid 88 in vessel 85 is monitored and controlled by Level-Indicator-Controller 7 (LIC-7). LIC-7 receives an electronic level indication via connection 92 from a conventional level indicating device 91 on vessel 85. The device 91 is typically a simple "d-p" cell or a gamma radiation level detection device, though other forms of level detection/indication may be used. Based on this signal and the preset desired level in vessel 85 (typically supplied by an operator), LIC-7 transmits an electronic control signal 93 to Level-control Valve controller 7 (LV-7) which regulates the flow through control valve 94 and thus the flow of liquid from pump 141 through conduit 142 to, for example, digester 32. As the level 88 in vessel 85 increases beyond the set value or range of values, LIC-7 sends a signal to controller LV-7 opening valve 94 and allowing more flow to be pumped from conduits 140 and 138 and thus less flow passes to vessel 85 and conduit 118 via conduits 90 and 143. Regulating the level 88 via a control loop associated with valve 94 is a particularly desirable method of regulating the level of liquid in vessel 85 when little or no liquid is introduced to the vicinity of the inlet of pump 121, for example, via conduit 143 When operating with little or no flow directly to the inlet of pump 121 it is especially desirable to monitor the level 88, for example, by using a gamma-radiation level detection device.

A Pressure-Indicator-Controller (PIC) 95 also preferably controls the operation of pump 141. A pressure indicator 96 on conduit 140 senses the pressure in conduit 140 and sends a corresponding electrical signal 97 to PIC 95. Should the pressure in conduit 140 fall below a predetermined pressure at which the pump 141 will not operate properly, the controller PIC 95 will send an electrical signal to a conventional controller (not shown) controlling the pump motor (not shown) to reduce the speed of or stop pump 141 to protect pump 141 from cavitating. For example, should separator 137 become plugged and no liquid flow is present in conduits 138 and 140 the pressure in these conduits will drop so that an insufficient net positive suction head is provided to pump 141. This loss of pressure can cause cavitation and damage to the pump 141 should it continue to operate. In addition, PIC 95 may also control the operation of pump 121 to ensure that sufficient suction head pressure is provided for pump 141.

The flow of liquid to vessel 85 and conduit 118 is preferably controlled by Flow-Indicator-Controllers 13 (FIC-13) and 15.(FIC-15). FIC 13 is the primary control loop which controls the flow of liquid through valve 99 and conduit 143. The flow in conduit 143 is detected by flow sensing device 100, for example, a magnetic flow meter (or "mag meter") or orifice-plate-type flow indicator, and a corresponding electrical signal 101 is sent to FIC 13. Based upon a predetermined desired flow rate, typically input by an operator and based upon the production rate (though the flow rate may also be determined by computer computation from other parameters), FIC-13 sends a corresponding electronic control signal 102 to automatic control valve 99 to regulate the flow through valve 99, or to substantially completely open or close valve 99, and increase or decrease the flow of liquid to conduit 118, or to vessel 85 via conduit 103 (which is downstream of valve 99 and substantially directly connected to tank 85).

In a similar fashion, if necessary, for example, during fluctuations in the normal operation of feed system 111 or under start-up conditions, FIC-15 may supplement the flow of liquid to vessel 85 via conduit 90. Flow indicator 104, similar to indicator 100, detects the flow in conduit 90 and sends a corresponding electrical signal 105 to FIC 15. Then, based upon a predetermined flow value either input by an operator or computed, FIC-15 sends an electronic control signal 105 to automatic flow control valve 106 to vary the flow to vessel 85 via conduit 90. Again, the primary flow of liquid to vessel 85 and conduit 118 typically passes through conduits 143, 103 alone and little or no flow may pass through conduit 90.

Also, Flow control Valve 4 (FV-4) may also be provided to control the flow of liquid through valve 107 and conduit 108. Typically, the liquid in conduit 108 is supplied to conduit 140 and to the inlet of pump 141 to provide the sufficient liquid pressure and volume needed during start-up conditions. The liquid in conduit 108 may be any available source of liquid, but is preferably weak black liquor obtained from a downstream washing process or spent cooking liquor, that is, black liquor removed from the digester 32, preferably after having its temperature reduced either by flashing or indirect cooling in a heat exchanger. Once operation begins and the feeder 124 is operating, the liquid in conduits 138 and 140 is obtained from conduits 128 and 136 via separator 137, and FV-4 can be closed so that little or no flow is introduced to conduit 140 via conduit 108. FV-4 can also be used to supply liquid to the inlet of pump 121 during start-up via conduits 140, 90, vessel 85, and conduit 81.

Compared to the prior art system shown in FIGS. 1 and 2, the system of FIG. 3 with the liquor level 88 maintained in a vessel 85 surrounding conduit 118 the liquor storage tanks 39 and 45 are not needed. The function of controlling the amount of liquid provided to the inlet of pump 21, 121 and to digester make-up via pump 41, 141 is provided by a single vessel 85, integral with the chip feeding conduit 118. It is to be understood by those skilled in the art, that the storage and level controlling function of vessel 85 can also be effected by a vessel not integrally related to conduit 118 but which has liquid communication with conduit 118. By combining the level controlling function with the liquor storage and supply function into a single vessel (for example, vessel 45 in FIG. 2), at least one vessel, that is, vessel 39 (FIG. 2) of the prior art, may be eliminated without affecting the desired operation of the feed system.

One benefit of passing liquid from the separator. 137 directly to the inlet of pump 141 via conduits 138 and 140, that is, without passing through a conventional vessel 39 (see FIGS. 1 and 2), is that the liquid in conduits 138 and 140 will have been pressurized by pump 121. Under such positive pressure, it is more likely that sufficient pressure is available at the inlet of pump 141 to provide sufficient Net Positive Suction Head (NPSH) for pump 141, so that pump 141 operates properly. For example, passing liquid from the separator 137 directly to pump 141 reduces the potential for cavitation to occur in pump 141 due to insufficient NPSH. Providing a higher pressure liquid to the inlet of pump 141 (for example, an increase of about 2 bars compared to passing the liquid vessel through a vessel 39) can also increase this pump's pumping capacity and, as a result, increase the capacity of the entire digester system.

FIG. 4 illustrates another embodiment of the tank/conduit structure of the present invention. Almost all the structures of FIG. 4 are identical to the structures of FIG. 3 and many of these structures have ether been omitted for clarity or included and identified by identical reference numbers. FIG. 4 includes a vessel 116, a transition 80, a metering device 117, a conduit 118, a radiused conduit 120, pump 121 and a conduit 122 which are essentially identical and perform substantially the same functions as the structures identified and discussed with respect to FIGS. 1, 2 and 3. However, unlike the embodiment of FIG. 3, in the embodiment of FIG. 4 the conduit 81 has been replaced by a transition 181.

The transition 181 comprises or consist of one or more transitions exhibiting one-dimensional convergence and side-relief geometry similar to the transition at the bottom of vessel 116, that is, a transition geometry as marketed by Ahlstrom Machinery under the trademark DIAMOND-BACK and disclosed in U.S. Pat. Nos. 4,958,741; 5,500,083; 5,617,975; 5,628,873; and 5,700,355 (which are incorporated by reference herein). Transition 181 receives a slurry of chips and liquid from vessel 185 having an upper section 1.86, a lower transition 187, and a liquid level 188 as shown by similar structures in FIG. 3. The outlet of transition 181 is connected to radiused conduit 120, pump 121, and conduit 122, and to digester 32 as discussed with respect to FIG. 3. The outlet of conduit 118 may include a perforated cylindrical screening element similar to screen 89 in FIG. 3. This screen element, similar to screen 89, may be attached to transition 181 so that the flow of chips into vessel 185 is minimized.

The embodiment of FIG. 5 differs primarily from that of FIG. 3 as follows:

- an integral level tank/chip tube 285 in which the chip tube passing through the tank comprises a cylindrical screen 289 along substantially its entire length;
- the feeding conduit 281 below the tank 285 feeds the slurry directly to the inlet of the chip pump 221 without a radiused conduit (120 in FIG. 3);

the chip slurry is fed to the HPF 224 in an upward direction to simplify this pipe run (though a bar screen 277 is shown in the HPF low pressure outlet, it is to be understood that this screen 277 may be omitted);

the optional in-line drainer 237 is mounted directly above the low pressure outlet of the HPF 224, the chip and liquor slurry from the in-line drainer is returned to the chip tube through line 243; and an optional controlled flow of liquid (line 301) is removed from the integral chip chute/level tank 285 and directed to the inlet of the make-up liquor pump 241.

FIG. 5 illustrates a preferred embodiment of the system shown in FIG. 3. The system of FIG. 5 includes a chip bin 216, a metering device 217, an integral chip tube/level tank/surge tank 218, 285, a chip pump 221, a High-pressure Feeder 224, an optional In-line Drainer 237, a Make-up Liquor pump 241, and a Top Circulation pump 229 that are essentially identical to and perform the same function as the same devices described with respect to FIG. 3. FIG. 5 also shows the direction of rotation of chip meter 217 by arrow 217', and the direction of rotation of the High-pressure Feeder 224 by arrow 224'.

Though the integral chip chute/level tank 85, shown in FIG. 3, or 185, shown in FIG. 4, may be used in the system of FIG. 5, an alternative chute/tank 285 having a cylindrical vessel 286 and a through-going conduit 218 is shown in FIG. 5. Inside vessel 286, conduit 218 includes a perforated (or screen) section 289, for example, comprising (substantially over its entire length or over a portion of its length) perforated plate or spaced parallel bars such that the liquid in tank 286 communicates with the liquid in conduit 218 having a essentially common liquid level 288.

Though the High-pressure feeder 224 is shown with screen 277 in its low-pressure outlet, in a preferred embodiment of this invention, this screen 277 is omitted. As a result, without the screen 277, comminuted cellulosic fibrous material, for example, wood chips, may pass through the feeder 224 and in-line drainer 237 and via conduit 243 be re-introduced to the chip tube 218. The flow in conduit 243 is typically controlled by a flow control valve 299. This flow control valve typically receives a control signal from a automated flow-indicator-controller (FIC) 201 which receives a flow signal from flow detector 200, for example, a magnetic flow meter, in conduit 243. FIC 201 also typically receives the input of a desired flow from a human operator. In one embodiment of this invention, the in-line drainer 237 is omitted and conduit 243 receives a flow of liquid, and possibly chips, directly from the low-pressure outlet of feeder 224, and returns it to conduit 218.

When the in-line drainer 237 is present, the essentially chip-free liquor removed from the drainer 237.is passed via conduit 238 to the inlet of pump 241, referred to as the "Make-up Liquor Pump" (MULP). Pump 241 pressurizes the liquor removed from drainer 237 so that it can be introduced to the digester 32 (see FIG. 1). As an alternative, the liquid in conduit 238 may in introduced to conduit 231, the Top Circulation (or TC) line, via conduit 338, or to conduit 234, the TC return line, via conduit 438. Cooking chemical, for example, kraft white liquor, black liquor, green liquor, or orange liquor (that is, with polysulfide added), etc., is typically added to conduit 238 via conduit 307. The liquid in conduit 238 may be introduced to one, two, or all of the locations indicated in FIG. 5.

When the in-line drainer 237 is not present, conduit 238 receives liquid, and possibly chips, directly from high-pressure feeder 224 via conduit 243.

The flow in conduit 238 is typically controlled via level control valve 294. Valve 294 receives a control signal 293 from automated level-indicator-controller. (LIC) 202. LIC 202 also receives a control signal 292 from level indicator.291 located on vessel 286. The controller 202 also typically receives a input of the desired level from a human operator.

The system shown in FIG. 5 may also include a conduit 301 for removing liquid from vessel 286 and forwarding it to conduit 238 and pump 241. The flow in conduit 301, shown in phantom in FIG. 5, is typically controlled by a flow control valve 302. This flow control valve typically receives a control signal from an automated flow-indicator-controller (FIC) 304 which receives a flow signal from flow detector 303, for example, a magnetic flow meter, in conduit 301. FIC 304 also typically receives the input of a desired flow from a human operator.

The most simplified embodiment of the invention shown in FIG. 5 does not include an in-line drainer 237, does not include conduit 301, and does not includes High-pressure feeder screen 277. Furthermore, this system preferably includes an integral level tank/surge tank/chip tube 85 shown in FIG. 3 without having a screen 89, 289 in conduit 118.

Figure 6:
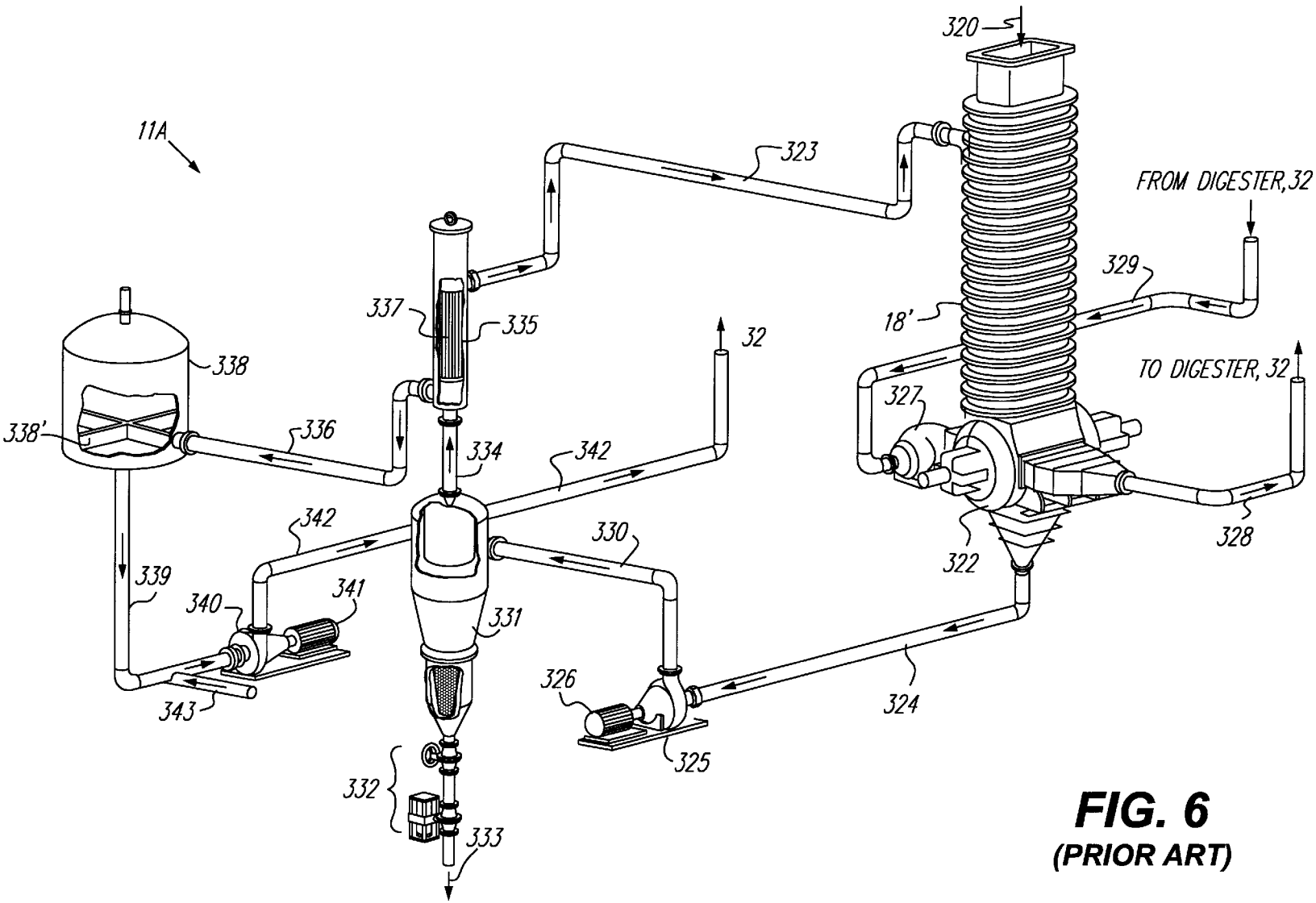
FIG. 6 (PRIOR ART)
FIG. 6 is a view like that of FIG. 2 of another exemplary conventional prior art system.

FIG. 6 is an isometric schematic detail of the lower half of another conventional prior art chip feed system 11A, similar to those shown in FIGS. 1 and 2, for feeding comminuted cellulosic fibrous material to the digester 32. In the system shown in FIG. 6, steamed wood chips 320 (which have typically been treated with steam to remove air and initiate the heating process) are introduced to a Chip Chute 321 positioned above a high-pressure transfer device 322, that is, a High-pressure Feeder as sold by Ahlstrom Machinery. Cooking liquor is first introduced to the chips in chute 321 by a conduit 323 such that a slurry of chips and liquor:are produced in chute 321. In this conventional prior art system, the slurry of chips and liquor in chute 321 is drawn into the pocketed rotor (not shown) in High-pressure Feeder 322 by a Chip Chute Circulation Pump 325 via conduit 324. Pump 325 is driven by electric motor 326. The chips are retained in the pocket of the High-pressure Feeder 322 rotor by a bar-type screen (not shown) so that preferably the liquor in conduit 324 is essentially free of wood chips though some small wood particles, for example,"fines" or "pin chips", do pass through the screen in the High-pressure Feeder 322. As the pocketed rotor of the feeder rotates, the chips that are retained in the High-pressure. Feeder 322 are exposed to high-pressure liquor introduced by pump 327 and are flushed via conduit 328 to digester 32. Excess liquor used to slurry the chips in conduit 328 is removed by a dewatering device (33 in FIG. 1) at the inlet of the digester 32 and returned to the pump 327 via conduit 329. One typical dewatering device is the Top Separator 33 shown in FIG. 1. The liquor returned to pump 327 via conduit 329 is used to slurry the chips out of the High-pressure Feeder 322.

The liquor removed through the bar-type screen in the low-pressure outlet of High-pressure Feeder 322 and passed through conduit 324 is re-circulated to the Chip Chute by pump 325. The liquor is first pumped via conduit 330 to a cyclone-type separator 331 for removing sand and other debris from the liquor that may cause accelerated wear to the High-pressure Feeder or other components. This separator 331 is typically a Sand Separator as sold by Ahistrom Machinery, but any separating device which performs a similar function may be used. The accumulated debris 333 is intermittently removed from separator 331 by operating valves 332. The liquor is discharged from separator 331 into liquor separating device 335 via conduit 334. This separator, typically an In-line Drainer sold by Ahlstrom Machinery, removes liquor from the circulation via conduit 336. The separator 335 typically includes a cylindrical parallel-bar-type screen 337 which prevents wood chips or other debris from being removed via conduit 336. If wood chips or fines were introduced to conduit 336 they could be introduced to the inlet of pump 340. Pump 340 is typically not capable of handling chips or fines in the liquor without causing accelerated wear or even pump failure. The liquor and wood chips retained by screen 337 and discharged to conduit 323 is returned to Chip Chute 321 via conduit 323.

The liquor removed from separator 335 via conduit 336 is forwarded to a retention tank 338, typically a Level Tank as sold by Ahlstrom Machinery. Liquor is withdrawn from tank 338, having interior baffles 338'; via conduit 339 by pump 340, driven by electric motor 341. Retention tank 338 ensures that an adequate supply of liquor and an adequate pump suction pressure are available at the inlet of the pump 340. Pump 340, typically a Make-up Liquor Pump sold by Ahlstrom Machinery, pumps the liquor via conduit 342 to digester 32. Typically, the liquor removed from separator 335 is regulated by a control valve (not shown) to ensure a predetermined level of liquor in Chip Chute 321. Cooking liquor, for example, kraft white liquor, black liquor, orange liquor, or green liquor, is typically introduced to conduit 339 via conduit 343.

Figure 7:
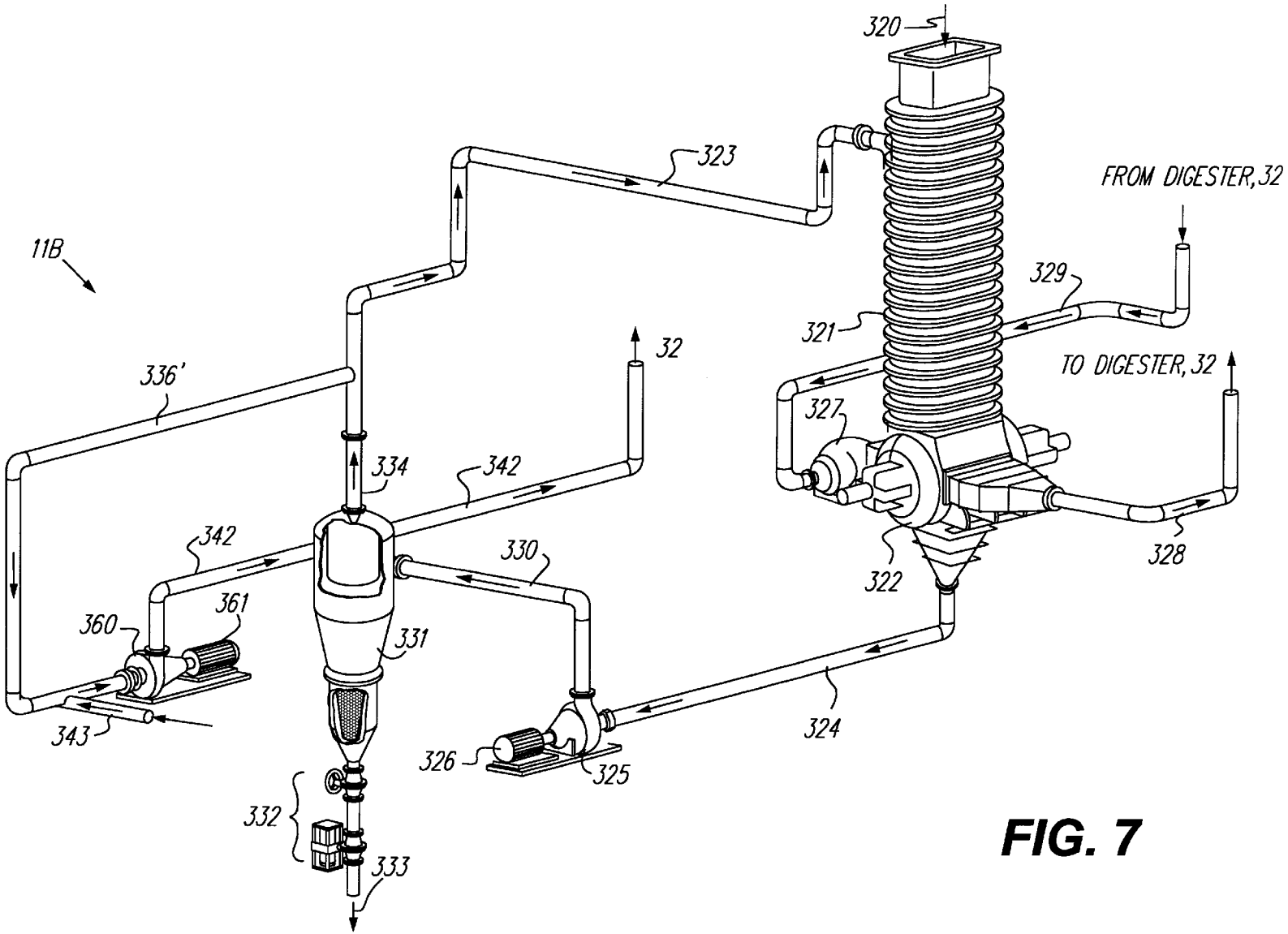
FIG. 7 is a view like that of FIG. 6 only showing an embodiment according to the present invention which modifies the prior art system.

FIG. 7 is an isometric schematic illustration of one embodiment of the present invention as it is applied to the prior system shown in FIG. 6. Most of the items identified in FIG. 7 are identical to those shown in FIG. 6 and have been identified using the same reference numbers. However, by employing the present invention both the liquor separator 335 and the tank 338 shown in FIG. 6 may be eliminated in the system 11B of FIG. 7. Instead pump 340 in FIG. 6 has been replaced by pump 360, driven by motor 361, in FIG. 7. Pump 360 is preferably a pump which is not affected by the presence of wood particles, such as sawdust, chips, fines, or other undesirable material present in the liquor passed to it by conduit 336'. One preferred pump 360 is the Hidrostal helical screw pump mentioned above, though other pumps may be used. The removal of separator 335 and tank 338 dramatically simplifies, reduces the cost, and reduces the maintenance of the feed system used to feed chip slurries to a digester. Though FIG. 7 illustrates a cyclone separator 331, according to this invention the separator 331 may also be eliminated so that conduit 330 communicates directly with conduit 334.

Pump 360 performs the same function as pump 340, in FIG. 6, that pump 360 replaced Pump 360 returns excess liquor to digester 32. However, the liquor passed to the digester 32, since it was removed from conduit 334 without using a straining device, will contain a higher percentage of wood particles, such as chips and fines, and if device 331 is eliminated, sand and other debris.

The amount of liquor forwarded to digester 32 via conduit 342 is typically controlled automatically. For example, conduit 342 may typically include a conventional automatic flow control valve (not shown) and chute 321 typically includes a level sensor (not shown). The flow of liquor through the control valve in conduit 342 can be automatically controlled to maintain a predetermined level of liquid in chute 321. Also the pressure in line 323 in FIG. 7 is typically monitored and controlled via a conventional pressure indicator and a conventional pressure control valve (not shown).

In the FIG. 7 embodiment the conduits 324, 330, 334, 323, the pump 325, and the centrifugal separator 331 are part of the return system for returning liquid from the transfer device 322 to the slurrying device (chip chute 321). The return system is devoid of an in-line drainer and level tank.

Figure 8:
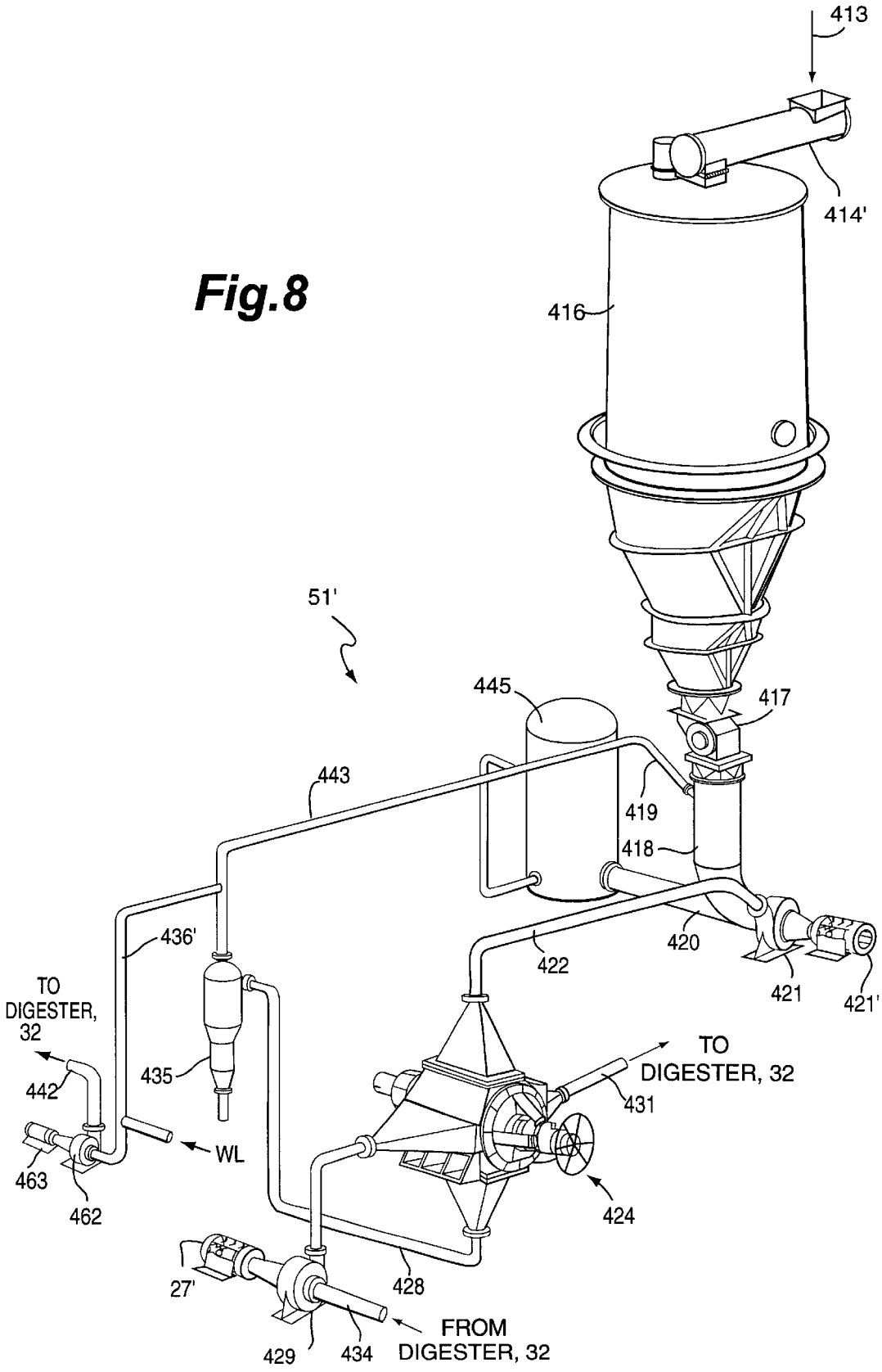
FIG. 8 is a view like that of FIG. 2 only modifying the prior art system of FIG. 2 according to the present invention.

A similar application of the present invention to the prior art system shown in FIG. 2 is illustrated in FIG. 8. Here again, many of the items identified in FIG. 8 are identical to those shown in FIG. 2 and are identified in FIG. 8 using the same reference numbers, only preceded by a "4". As in FIG. 7, drainer 37 and tank 39 can be eliminated from the system of FIG. 2 by substituting pump 462, driven by motor 463, in FIG. 8 for pump 41 in FIG. 2. Again, pump 462 is preferably a pump which is not affected by the presence of wood particles or other undesirable material present in the liquor passed to it by conduit 436', the Hidrostal or its equivalent being preferred. Again, as discussed with respect to FIG. 7, according to the present invention the separating device 435 shown in FIG. 8 may also be eliminated such that liquid passes from conduit 428 directly to conduit 443.

As described with respect to FIG. 7 above, the system of FIG. 8 also preferably includes certain automatic controls. The amount of liquor forwarded to digester 32 via conduit 442 in FIG. 8 is typically controlled automatically. For example, conduit 442 may typically include a conventional automatic flow control valve (not shown) and liquor tank 445 typically includes a conventional level sensor (not shown). The flow of liquor through the control valve in conduit 442 can be automatically controlled to maintain a predetermined level of liquid in liquor tank 445. Also the pressure in line 443 in FIG. 8 is typically monitored and controlled by a conventional pressure sensor and conventional pressure control valve (not shown).

In the FIG. 8 embodiment the conduits 428, 443 and. 419 and the centrifugal separator 435 comprise the return system for returning liquid from the transfer device 424 to the slurrying device (chip tube 418 or tank 85,185, 285). The return system is devoid of an in-line drainer and level tank.

Figure 9:
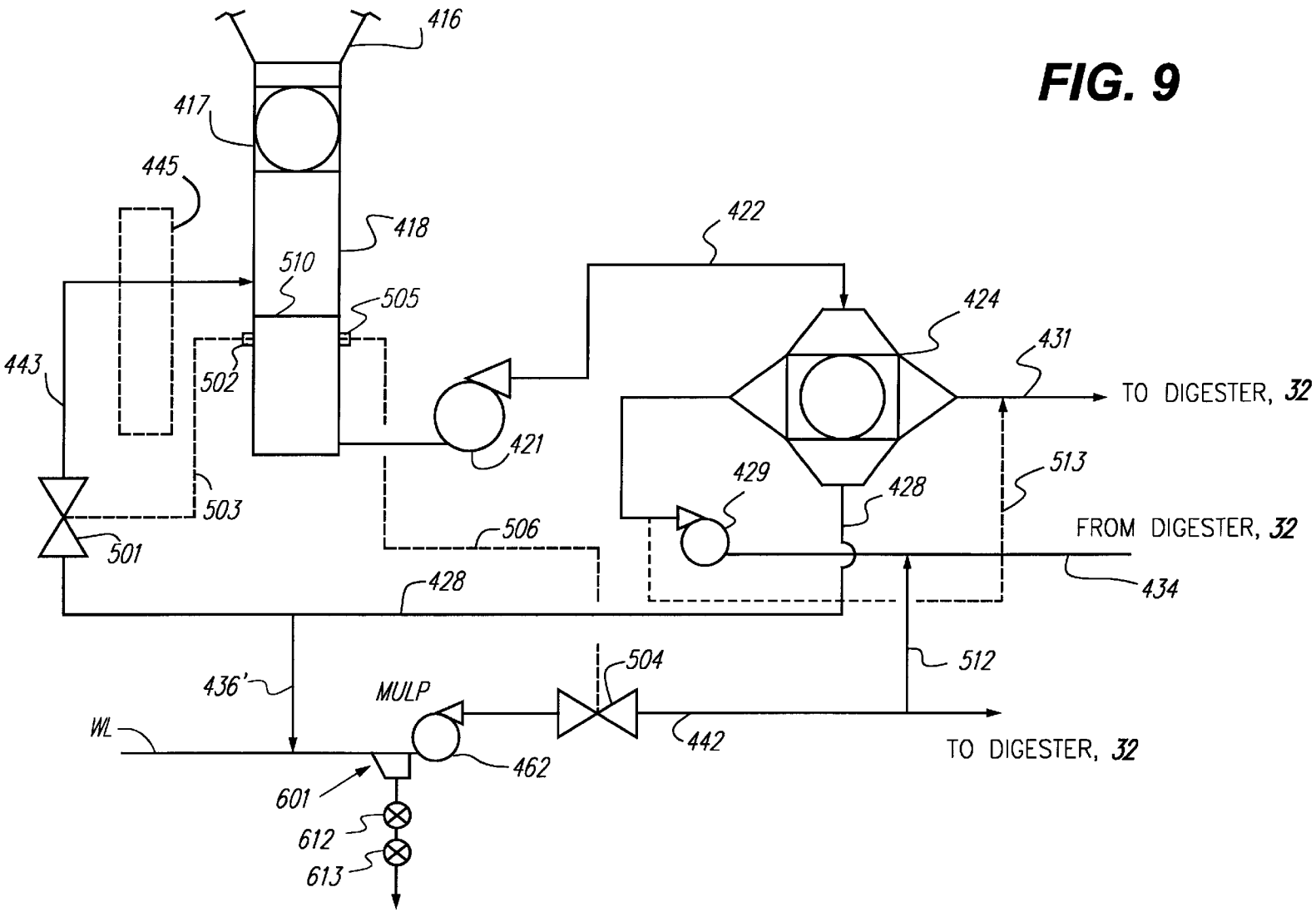
FIG. 9 is a schematic illustration of an exemplary feed system according to the present invention which is a modification of the system of FIG. 8.

The embodiment of FIG. 9 is another modification according to the invention which in some ways is an improvement of the embodiment of FIG. 8. As before, the HPF 24 screen, the In-line Drainer 37, the Sand Separator 35, and the Level Tank 39 of the prior art of FIG. 2 have been eliminated. Unlike the system of FIG. 8, however, the system shown in FIG. 9 includes:

- the use of the integral chip chute/surge tank/level tank like elements 85,185 and 285 of FIGS. 3–5, though the surge tank can be used as an option;
- an optional tramp material trap 601 positioned anywhere in the feed system, but preferably located upstream of the Make-up Liquor Pump (MULP) 462;
- two optional level control schemes: one (503) controlling the make-up liquor flow and one (506) controlling the chip chute circulation flow; and
- the make-up liquor flow may optionally be returned to the digester 32, the top circulation flow 431 to the digester 32, or the top circulation return 434 from the digester 32 (FIG. 1).

Figure 10:
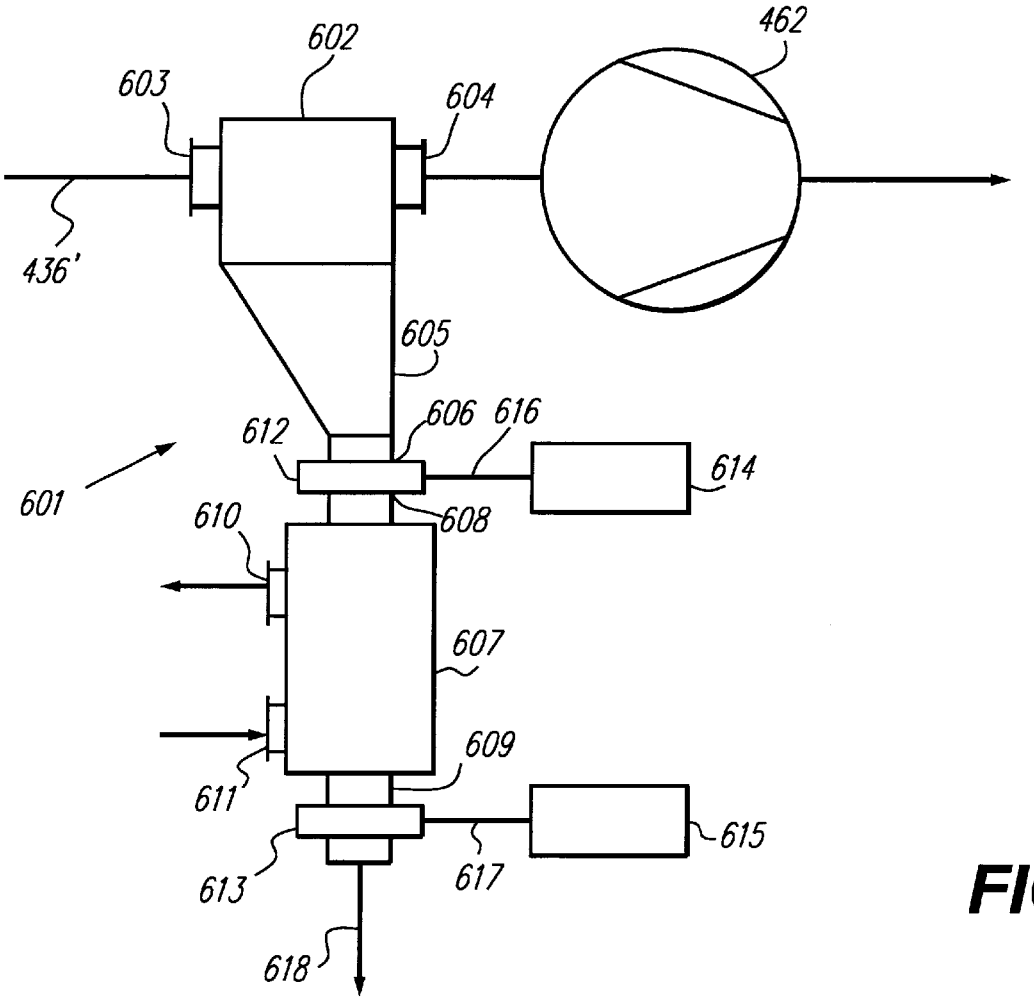
FIG. 10 is a schematic detail view of the tramp metal trap of FIG. 9.

The optional tramp material trap (601) removes the debris that, for example, is conventionally retained by the screen located in the low-pressure outlet of the high-pressure feeder 424. Where conventionally this debris is passed to digester 32 (with little or no impact upon the operation of the digester), this debris can affect the operation of, for example, pump 462, and therefore is preferably removed. A proposed detail for the trap 601 is shown in FIG. 10.

FIG. 9 is a schematic illustration of an even more preferred embodiment of the invention shown in FIG. 8. As described with respect to FIG. 8, the conventional HPF 424 screen; conventional. In-line Drainer (item 37 in FIG. 2);

conventional Sand Separator (item 35 in FIG. 2); and Level Tank (item 39 in FIG. 2) are eliminated from the feed system shown in FIG. 9. It is to be understood that one or more of these devices may be used in the embodiment shown in FIG. 9 while not detracting from the novelty or advantages of the disclosed invention. The reference numbers used to identify the same structures or devices shown in FIG. 9 are similar to those shown in FIG. 8.

The system schematic shown in FIG. 9 includes a chip bin 416 (only the bottom of the bin is shown), a chip meter 417, a chip chute or tube 418 (having a liquid level 510), a chip pump 421, a High-pressure Feeder 424, a Top Circulation pump 429, and a Make-up Liquor pump 462 that are essentially identical to and perform the same function as the same devices described with respect to FIG. 8. The chip tube 418 preferably is an integral chip chute/level tank/surge tank as illustrated in FIGS. 3 and 5 at 85, 185, 285. The system may also include a separate surge tank/level tank 445 in addition to or in lieu of the integral chip chute/level tank 418.

FIG. 9 also illustrates two optional devices which control the level 510 in chute 418. In one case the level is controlled via a level control valve 501 in conduit 443. The valve controller for valve 501 (not shown) receives a level control signal from level sensor 502 on chute 418 via control signal 503. In the second case the level control valve 504 in conduit 442 controls level 510. The valve controller for valve 504 (not shown) receives a level control signal from level sensor 505 on chute 418 via control signal 506.

The discharge from the Make-up Liquor Pump 462, which is typically directed to digester 32 via conduit 442, may also be directed to the Top Circulation line 431 via conduits 512, 513; to the Top Circulation-return line 434 via conduit 512; or to the discharge of pump 429 via conduit 514. The most preferred of these options is to direct the liquor from pump 462 to the outlet of pump 429 since introducing liquor there will reduce the volume of liquor that need be pumped by pump 429. The next preferred option is to introduce the liquor pumped by pump 462 to conduit 431 via conduits 513 and 512. The least preferred option is to introduce liquor to conduit 434 via conduit 512. One of skill in the art recognizes that the liquor provided by pump 462 may be directed to one, two, or all of these locations and still be within the scope of the present invention.

In the FIG. 9 embodiment, the conduits 428 and 443 and the valve 501 (when used) comprise the return system for returning liquid from the transfer device 424 to the slurrying device (chip tube 418 or tank 85, 185, 285). The return system is devoid of an in-line drainer, level tank, or centrifugal separator (e. g. sand separator).

A schematic illustration of one preferred material trap 601 shown in FIG. 9 is shown in FIG. 10. This trap 601 is used to isolate tramp material that may be entrained in the liquid passing in, for example, conduit 436'. Tramp material typically includes, but is not limited to, rocks, stones, nuts and bolts, nails, sand, knots or any other foreign, typically dense, non-cellulose material that is undesirable in the liquids and slurries of the system shown in FIG. 10 or the digester 32 this system feeds. In FIG. 10 the trap 601 is located in conduit 436' immediately upstream of pump 462; however, trap 601 may be located anywhere in the feed system shown in FIG. 9 where it is most advantageous. For example, trap 601 may also be located in one of conduits 428, 434, or 512. Also, the system shown in FIG. 9 may also included the material trap disclosed in U.S. Pat. No. 6,024,227.

The trap 601 shown in FIG. 10 includes a collection chamber 602 having an inlet 603 and an outlet 604 which communicate, for example, with conduit 436'. Chamber 602 is larger in dimension than conduit 634 so that the energy or pressure of the tramp-material-containing liquid passing through conduit 436' is somewhat dissipated so that its flow velocity decreases and the denser tramp material is allowed to settle in the lower section 605 of chamber 602. The lower section 605 includes a discharge outlet 606 through which the accumulated tramp material may be discharged.

One method of controlling this discharge out of outlet 606 is shown in FIG. 10. This includes a collection chamber 607 having an inlet 608 for tramp material, a discharge 609, a relief outlet 610, and a purge inlet 611. A valving device 612 is located between the outlet 606 of the lower collection chamber 605 and the inlet 608 of chamber 607. A similar valving device 613 is positioned in the outlet 609 of chamber 607. These valving devices may be ball-type valves, gate-type valves, or whatever type of valving device is appropriate for this application. In the system shown in FIG. 10 the valving devices 612, 613 are gate-type devices controlled by hydraulic or pneumatic actuators 614, 615 via connecting rods 616, 617. The actuators 614, 615 are typically controlled by electronic controllers (not shown) that periodically open and close valves 612, 613 to remove tramp material that has accumulated in chamber 602.

The trap 601 typically operates as follows. First, the valve 613 is closed by actuator 615. After a predetermined time period, typically about 10–30 minutes, actuator 614 opens gate valve 612 allowing the material which is accumulated in chamber 602 to be discharged to chamber 607. Typically, chamber 602 is at a higher pressure than chamber 607 and the tramp material or debris is ejected from chamber 602 under pressure into chamber 607. After a predetermined time period, typically about 10–30 seconds, valve 612 is closed, again isolating chamber 602 from chamber 607. After valve 612 is closed, valve 613 is opened by actuator 615 for a predefined length of time, typically about 10–30 seconds, and the tramp material is discharged from chamber 607 through valve 613 to a safe location as shown by arrow 618, for example, to a waiting wheel barrow. The discharge of the material from chamber 607 may be aided by the introduction of purge water to the inlet 611 (controlled by a conventional valve which is not shown) while valve 613 is open and the material is being discharged. After discharge of the material form outlet 609, valve 613 is closed and the process described is repeated. Pressure may be relived from chamber 607 before, during, or after discharge via outlet 610 controlled by a conventional valve (not shown).

Figure 11:
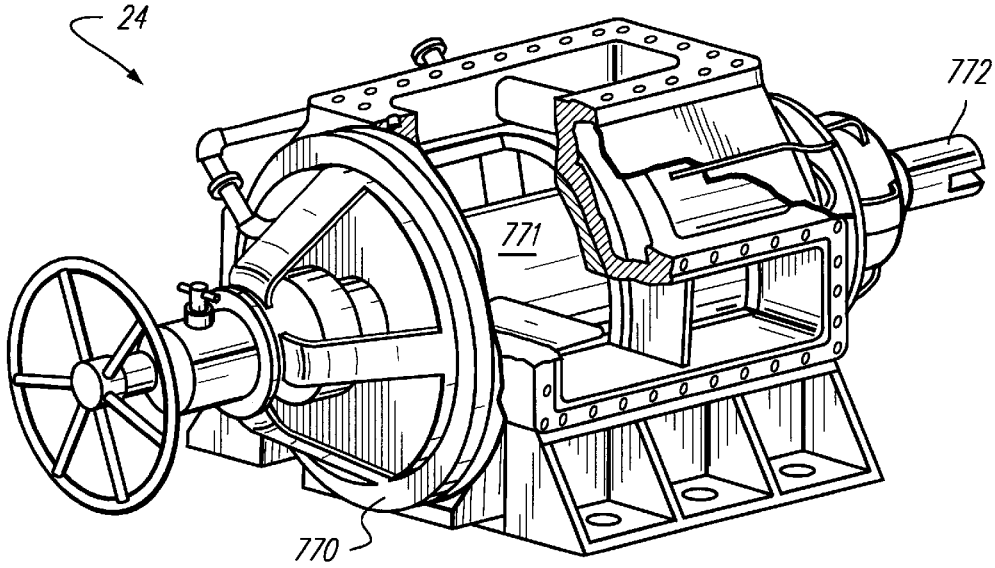
FIGS. 11 and 12 are isometric and cross-sectional views, respectively, of a conventional high pressure transfer device that may be modified according to the invention.
Figure 12:
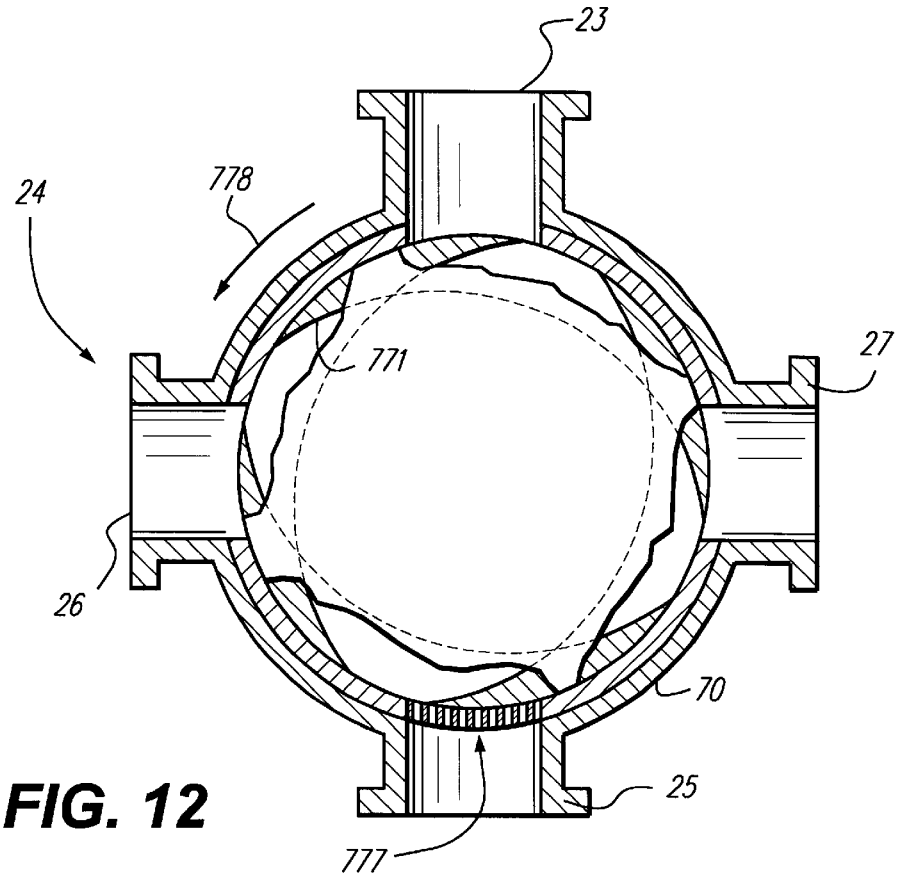
Figure 14:
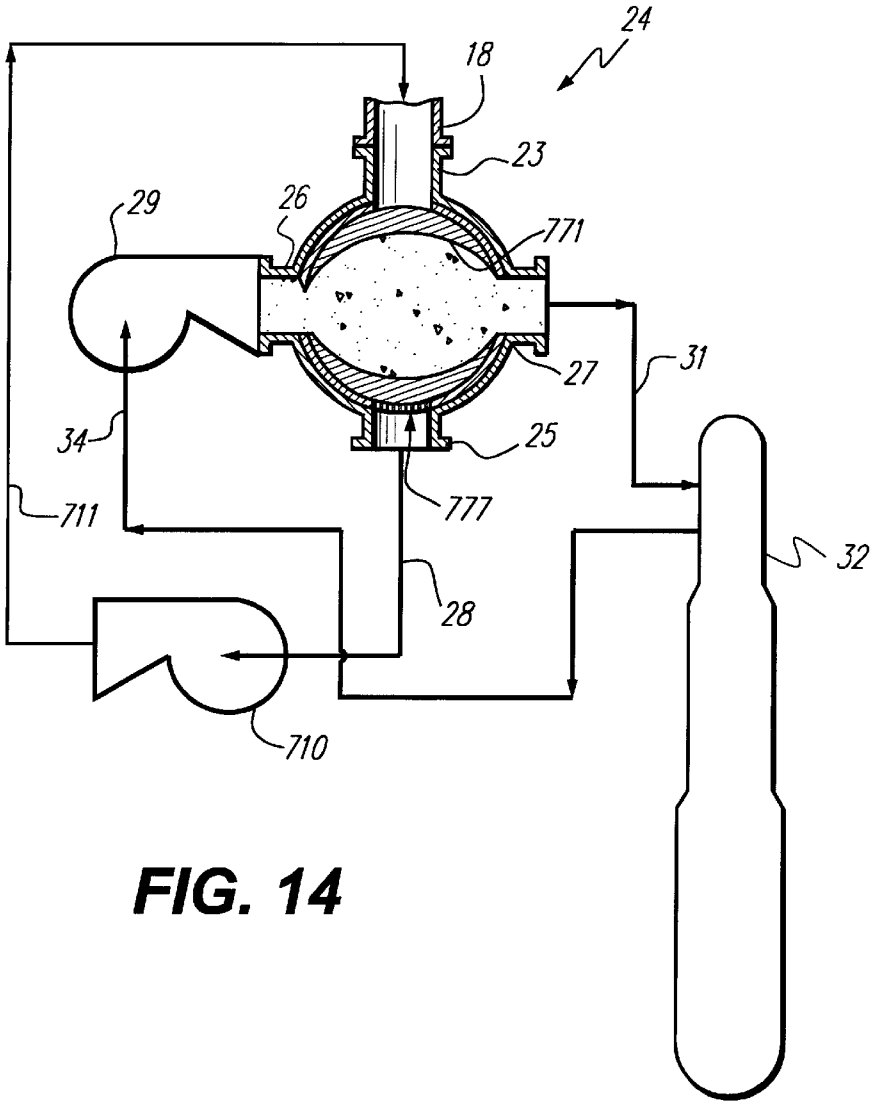
FIGS. 13 and 14 are schematic views showing the device of FIG. 11 in association with other components showing the functionality thereof, and which may be modified according to the invention.
Figure 13:
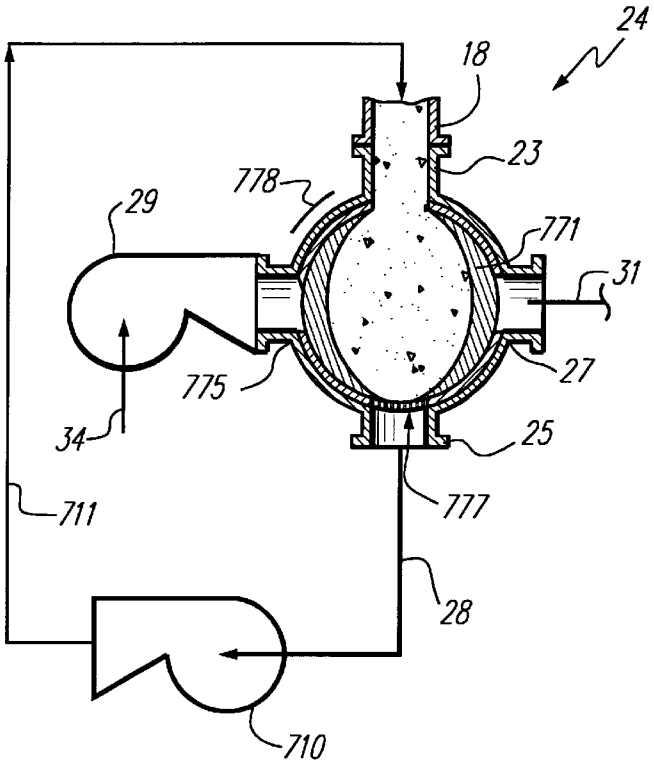

Another embodiment of the invention is illustrated in FIGS. 11–14. FIG. 11 shows an isometric view, partly in cross-section, of a High-pressure Feeder sold by Ahistrom Machinery, typically used as the high-pressure transfer device 24 as shown in FIG. 2. The feeder 24 comprises a housing 770 and a pocketed rotor 771, having a drive shaft 772 driven by a variable speed electric motor and speed reducer (not shown). FIG. 12 shows a cross-section of the feeder 24 shown in FIG. 11. As shown, the feeder 24 includes a low-pressure inlet 23 (see FIG. 2 also), a low-pressure outlet 25, a high-pressure inlet 26, and a high-pressure outlet 27. The feeder 24 also includes a bar-type screen 777 located in low-pressure outlet 25. The low-pressure inlet 23 receives a slurry of chips and liquor from, for example, a Chip Chute 18 as shown in FIG. 2 or a chip slurry pump 21 as shown in FIG. 2. As the chip slurry is introduced via inlet 23, the chips are retained in the feeder 24 by screen 777 and the liquor, along with some small wood particles, are conventionally removed via low-pressure outlet 25. This filling stage is illustrated schematically in FIG. 13. As the rotor 771 turns, as shown by arrow 778 (the rotor may alternatively turn in the opposite direction) the chips introduced into the pocket of the rotor 771 are exposed to high-pressure liquor at high-pressure inlet 26. As shown in FIG. 14, this high-pressure liquid provided by pump 29 displaces the chips out of the pocket and out of high-pressure outlet into conduit 31 and to digester 32. Excess liquor that is used to transfer the chips from the feeder 24 to digester 32 is removed from the slurry at the inlet of the digester 32 and returned via conduit 34 to pump 29 to provide the source of slurrying liquid, as is conventional. Also, as shown in FIGS. 13 and 14, and as is conventional, the liquor which passes through screen 777, either under the influence of the conventional pump 710 or the slurry pump 21 is returned to the inlet of chip chute 18 or chip tube 118 via conduit 711.

Though not illustrated in FIGS. 11–14, rotor 771 typically includes at least two pockets that pass through the rotor 771 so that when one pocket 771 is being emptied of chips, another pocket 771 is filling with chips. As a result, an essentially continuous flow of slurry is being discharged into conduit 31.

As noted earlier, during the handling of comminuted fibrous material, such as wood chips, or finely-divided cellulose material, for example, sawdust, by the conventional feeder 24 shown in FIGS. 11–14, the fine material typically either cannot be retained adequately by bar screen 777 or is undesirably retained between the screen bars plugging them and making the feeder inoperable. Thus, another embodiment of the invention comprises feeding comminuted cellulosic fibrous material in a feed system using a High-pressure Feeder 24 in which the screen 777 has been removed, allowing at least some cellulose material to exit low-pressure outlet 25 with the liquor. One advantage of removing this screen is an increase in feeder capacity. Removing this restriction to slurry flow can increase the amount of material that can be introduced to the feeder and transported to the digester per unit time. This invention is particularly applicable to the system shown in FIG. 8 employing Ahlstrom Machinery's LO-LEVEL feed system. This system does not require a Chip Chute Circulation pump 710, as shown in FIG. 7, or the In-line Drainer 37 or Level Tank 39 or Sand Separator 35, as shown in FIG. 2, the operation of each of which may otherwise be negatively affected by the presence of cellulose material. Though the removal of the bar-type screen 777 from the High-pressure Feeder 24 has been described as having specific applicability to the handling of finely-divided material, such as sawdust, it is evident to those of skill in the art that the removal of the screen 777 is applicable to other forms of comminuted cellulosic fibrous material, such as wood chips.

Also, when removing the screen 777 from the High-pressure Feeder 24 in conjunction with practicing the systems shown in FIGS. 7 and 8, since, the liquor returned via conduit 323, 443, is pressurized, some form of pressure regulation may be present in conduit 323, 443 of FIGS. 7 and 8. For example, conduit 323, 443 preferably contains a conventional pressure sensor, a conventional pressure control valve, and a conventional pressure controller (all not shown) in order to control the pressure of the liquid reintroduced to chute 321 of FIG. 7 or tube 418 of FIG. 8.

Though the elimination of the In-line Drainer 37, Level Tank 39, Sand Separator 35, and high-pressure feeder screen 777, and the use of a pump tolerant of cellulose material, can each simplify and enhance the feeding of material to a digester, the combination of removing two or more of these, or all of these devices, in conjunction with a cellulose material tolerant pump, is particularly advantageous.

Thus the process and apparatus of the present invention, among other things, provides a way of simplifying the handling and treating of comminuted cellulosic fibrous material used to produce chemical pulp. The present invention further also provides a method and apparatus for handling and treating comminuted cellulosic fibrous material, for example, finely-divided material, that heretofore was not possible or practical.

In the above description, all narrower ranges within a broad range are also specifically provided (i.e., 2–12 feet means 2–3 feet, 3–11 feet, 6–7 feet, and all other narrower ranges within the broad range).

As described above, the methods and devices of this invention provide for simplified supply of a slurry of comminuted cellulosic fibrous material and liquid to a cellulose pulp digester. It is to be understood that modifications and alterations can be made to the specific devices and methods disclosed in this application without deviating from the essence of the invention. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the invention limited only by the prior art.

What is claimed is:

1. A system for feeding comminuted cellulosic fibrous material in a liquid slurry to at least one digester, comprising:

a device which slurries comminuted cellulosic fibrous material in liquid;

a first pump for pumping slurry from said slurrying device to at least one digester;

a second pump for supplying make-up liquid to the digester;

a source of liquid for slurrying the comminuted cellulosic fibrous material; and a single tank which performs both the function of controlling the level of liquid in said slurrying device, and the function of storing and supplying liquid in association with said source to said second pump, so that said first pump is properly and effectively substantially continuously supplied with liquid slurry, and said second pump with liquid.

2. A system as recited in claim 1 wherein said slurrying device includes a substantially vertical conduit, and wherein said single tank substantially surrounds said conduit and is in liquid communication therewith.

3. A system as recited in claim 2 wherein said first pump is operatively connected to said substantially vertical conduit by a connecting conduit or transition; and wherein there is a gap between said substantially vertical conduit and said connecting conduit or transition; and wherein said single tank substantially surrounds said gap.

4. A system as recited in claim 3 wherein said gap has a substantially vertical dimension of between about 3–48 inches, and wherein a screen or strainer is provided at said gap to minimize the amount of comminuted cellulosic fibrous material passing into said single tank through said gap.

5. A system as recited in claim 4 wherein said substantially vertical conduit is in further liquid communication with said single tank by at least one opening in said conduit vertically above and spaced from said gap.

6. A system as recited in claim 2 wherein said single tank is substantially concentric with said substantially vertical conduit.

7. A system as recited in claim 2 wherein said single tank comprises a substantially right cylindrical upper portion and a substantially right circular cone frustum lower portion.

8. A system as recited in claim 2 wherein said single tank has a substantially right cylinder shape.

9. A system as recited in claim 2 further comprising a high pressure feeder connected to said first pump and having a low pressure outlet; an undesirable solids connected to said low pressure outlet; an in-line drainer connected to said separator; said in-line drainer having a first outlet line connected to said second pump, and a second outlet line connected to said slurrying device; and an automatically controlled flow-controlling valve in said second outlet line which controls the proportion of liquid from said in-line drainer flowing in said first outlet line compared to said second outlet line.

10. A system as recited in claim 9 wherein said second outlet line, downstream of said valve, is substantially directly connected to both said substantially vertical conduit above said single tank and to said single tank.

11. A system as recited in claim 1 wherein said single tank is spaced and distinct from said slurrying device.

12. A system as recited in claim 1 further comprising a high pressure feeder connected to said first pump and having a low pressure outlet; an undesirable solids separator connected to said low pressure outlet; an in-line drainer connected to said separator; said in-line drainer having a first outlet line connected to said second pump, and a second outlet line connected to said slurrying device; and an automatically controlled flow-controlling valve in said second outlet line which controls the proportion of liquid from said in-line drainer flowing in said first outlet line compared to said second outlet line.

* * * * *